US007091816B1

(12) United States Patent
Ito et al.

(10) Patent No.: US 7,091,816 B1
(45) Date of Patent: Aug. 15, 2006

(54) COMMON-MODE CHOKE COIL

(75) Inventors: Tomokazu Ito, Tokyo (JP); Takeshi Okumura, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/368,657

(22) Filed: Mar. 7, 2006

(30) Foreign Application Priority Data

Mar. 18, 2005 (JP) ..... P2005-080249
Oct. 25, 2005 (JP) ..... P2005-310156
Oct. 26, 2005 (JP) ..... P2005-311469

(51) Int. Cl.
*H01F 5/00* (2006.01)

(52) U.S. Cl. ..... 336/200

(58) Field of Classification Search ..... 336/65, 336/83, 200, 206–208, 232, 234
See application file for complete search history.

(56) References Cited

U.S. PATENT DOCUMENTS 6,710,694 B1 * 3/2004 Matsuta et al. ..... 336/200
6,992,556 B1 * 1/2006 Tada et al. ..... 336/200
7,002,446 B1 * 2/2006 Ito et al. ..... 336/200
2004/0263309 A1 * 12/2004 Ito et al. ..... 336/200

FOREIGN PATENT DOCUMENTS

| | | |
|---|---|---|
| JP | A 6-215951 | 8/1994 |
| JP | A 6-275439 | 9/1994 |
| JP | A 203737 | 8/1996 |
| JP | A 11-54326 | 2/1999 |

* cited by examiner

*Primary Examiner*—Tuyen T Nguyen
(74) *Attorney, Agent, or Firm*—Oliff & Berridge, PLC

(57) ABSTRACT

A common-mode choke coil comprises an insulating layer and first and second coil conductors. The first and second coil conductors are laminated with the insulating layer interposed therebetween and are magnetically coupled to each other. A width W (mm) and a length L (mm) of at least one coil conductor in the first and second coil conductors satisfy the relational expression of:

$$\sqrt{L/W} < (7.6651 - fc)/0.1385$$

where fc (MHz) is the cutoff frequency with respect to differential-mode noise.

13 Claims, 23 Drawing Sheets

(a)

(b)

(a)

(b)

COMMON-MODE CHOKE COIL

BACKGROUND OF THE INVENTION

1. Field of the Invention

The present invention relates to a common-mode choke coil used in electronic devices and the like.

2. Related Background Art

As a conventional common-mode choke coil, a common-mode choke coil disclosed in Japanese Patent Application Laid-Open No. HEI 8-203737 has been known. The common-mode choke coil disclosed in the above-mentioned publication comprises a pair of magnetic substrates and a multilayer body disposed between the magnetic substrates. The multilayer body has an insulating layer and two coil conductors laminated with the insulating layer interposed therebetween. When an interface such as cable is provided with such a common-mode choke coil, noises generated at the time of data transmission can be reduced.

SUMMARY OF THE INVENTION

Meanwhile, there has recently been a strong demand for speeding up the data transmission. One of methods realizing the speedup of data transmission increases the transmission frequency (e.g., 800 MHz). For employing this method, a common-mode choke coil which operates normally even at a high transmission frequency, i.e., one having a favorable high-frequency characteristic, is necessary.

It is an object of the present invention to provide a common-mode choke coil which can improve its high-frequency characteristic.

For normally operating a common-mode choke coil at a desirable transmission frequency, it has been known sufficient if the common-mode choke coil is designed such that its cutoff frequency with respect to differential-mode noise is about three to five times the transmission frequency. When a common-mode choke coil is desired to operate normally at a transmission frequency of 800 MHz, for example, its cutoff frequency is required to be about 2.4 to 4 GHz. Namely, for improving the high-frequency characteristic of a common-mode choke coil, its cutoff frequency must be made higher.

Therefore, the inventors conducted diligent studies in order to attain a higher cutoff frequency. As a result, the inventors have newly found that a correlation exists between a width and a length of a coil conductor in a common-mode choke coil and the cutoff frequency, thereby achieving the present invention.

The present invention provides a common-mode choke coil comprising first and second coil conductors laminated with an insulating layer interposed therebetween and magnetically coupled to each other, wherein a width W (mm) and a length L (mm) of at least one coil conductor in the first and second coil conductors satisfy the relational expression of:

$$\sqrt{L/W}<(7.6651-fc)/0.1385$$

where fc (MHz) is a cutoff frequency with respect to differential-mode noise.

When at least one of the first and second coil conductors has L and W satisfying the above-mentioned relational expression, the cutoff frequency fc becomes high. This can raise a transmission frequency at which the common-mode choke coil can operate normally, whereby the common-mode choke coil attains a favorable high-frequency characteristic.

Preferably, each of the first and second coil conductors has a substantially helical form including a plurality of linear portions and a plurality of bent portions connecting the linear portions to each other, whereas at least one bent portion in the plurality of bent portions is flexed by a predetermined curvature in the coil conductor satisfying the above-mentioned relational expression in the first and second coil conductors. Since the bent portion is flexed by a predetermined curvature, the coil conductor becomes shorter in this case than in a case where the bent portion has a form in which lines are connected to each other. As a result, the cutoff frequency fc becomes higher according to the above-mentioned relational expression, whereby the common-mode choke coil attains a better high-frequency characteristic.

Preferably, each of the first and second coil conductors has a helical form made of a curve. This can reliably make the first and second coil conductors shorter than those in spirals in which lines are bent. Consequently, the cutoff frequency fc becomes higher, whereby the common-mode choke coil attains a better high-frequency characteristic.

Preferably, each of the first and second coil conductors include a spiral portion, formed helically, having totally the same width and winding pitch of respective conductor patterns forming the coil conductors; the respective spiral portions of the coil conductors overlie each other with the insulating layer interposed therebetween; each spiral portion comprises four coil areas sectioned at intervals of 90 degrees with respect to a predetermined position within an inner area of the spiral portion; three of the four coil areas form an arc centered at the predetermined position; and the remaining one coil area comprises an arc region formed as an arc centered at a position separated by the winding pitch of the conductor pattern from the predetermined position and a linear region formed between one of the three coil areas and the arc region such that the conductor pattern becomes a line by the winding pitch of the conductor pattern.

One of techniques for raising the cutoff frequency shortens the line length of the respective conductor patterns forming the first and second coil conductors. For shortening the line length of the conductor patterns, it will be ideal if the respective conductor patterns of spiral portions in the first and second coil conductors are made circular. Since a spiral portion is continuously formed helically, however, it is impossible for the whole spiral portion to be made circular.

Therefore, in each of the spiral portions of the first and second coil conductors, the width and winding pitch of the conductor patterns are made totally the same. The spiral portion is divided into four coil areas sectioned at intervals of 90 degrees with respect to a predetermined position within an inner area of the spiral portion, among which three coil areas are formed as an arc centered at the predetermined position within the inner area of the spiral portion. The remaining one coil area is constituted by an arc centered at a position separated by the winding pitch of the conductor pattern from the predetermined position and a linear region formed between one of the three coil areas and the arc region such that the conductor pattern becomes a line. Here, in the spiral portion, the width and winding pitch are totally the same as mentioned above. Therefore, when the linear portion of the conductor pattern in the line region has a length identical to the winding pitch of the conductor pattern, the conductor pattern of the spiral portion is reliably formed continuously as a whole.

Consequently, the foregoing structure in which the spiral portion has such a substantially circular form (not completely circular since a portion of the conductor pattern is a line) is a pattern in which the line length of the conductor pattern of the spiral portion is most efficiently shortened. Such a structure reliably shortens the line length of the conductor patterns forming the first and second coil conductors, thereby raising the cutoff frequency of the common-mode choke coil. As a result, the common-mode choke coil attains a better high-frequency characteristic.

Preferably, each of the first and second coil conductors further comprise a lead portion, extending toward an edge portion of the insulating layer; wherein one of the three coil regions is provided with a junction between the spiral portion and lead potion, whereas the remaining one coil region is adjacent to the coil region having the junction between the spiral portion and lead portion. When each of the first and second coil conductors is provided with the lead portion, the first and second coil conductors can easily be electrically connected to external electrodes.

Preferably, a portion corresponding to the inner area of the spiral portion in the insulating layer is provided with an inner insulation removing portion for forming a magnetic path made by forming a hole and filling the hole with a magnetic material. When the insulating layer is provided with the inner insulation removing portion, the magnetic path is formed at the portion corresponding to the inner area of the spiral portion. This raises the impedance of the common-mode choke coil, thus making it possible to restrain noises from occurring.

Preferably, a portion corresponding to an outer area of the spiral portion in the insulating layer is provided with an outer insulation removing portion for forming a magnetic path made by forming a hole or cutout and filling the hole or cutout with a magnetic material, whereas the outer insulation removing portion is placed at a portion corresponding to a corner of a substantially square virtual perimeter surrounding the spiral portion in the insulating layer. When the insulating layer is provided with the outer insulation removing portion, the magnetic path is formed at the portion corresponding to the outer area of the spiral portion in the insulating layer, whereby the common-mode choke coil attains a higher impedance. When the outer insulation removing portion is placed at the portion corresponding to the corner of the substantially square virtual perimeter surrounding the spiral portion in the insulating layer in this case, the magnetic path can be secured at a portion corresponding to the outer area of the spiral portion in the insulating layer even if the size of the spiral portion is not reduced. Therefore, when a portion corresponding to the inner area of the spiral portion in the insulating layer is provided with an inner insulation removing portion for forming a magnetic path such as the one mentioned above, the size of the inner insulation removing portion is not affected. In this case, a closed magnetic path structure with a favorable space efficiency can be formed, so that the common-mode choke coil can attain a better impedance characteristic and further restrain noises from occurring.

Preferably, each of first and second coil conductors includes a spiral portion formed into a substantially circular helix; the respective spiral portions of the coil conductors overlie each other with the insulating layer interposed therebetween; a portion corresponding to an inner area of the spiral portion in the insulating layer is provided with a first insulation removing portion for forming a magnetic path made by forming a hole and filling the hole with a magnetic material; a portion corresponding to an outer area of the spiral portion in the insulating layer is provided with a second insulation removing portion for forming a magnetic path made by forming a hole or cutout and filling the hole or cutout with the magnetic material; and the second insulation removing portion for forming a magnetic path is placed at a portion corresponding to a corner of a substantially square virtual perimeter surrounding the spiral portion in the insulating layer. When the spiral portions of the first and second coil conductors are made substantially circular while the second insulation removing portion is placed at the portion corresponding to the corner of the substantially square virtual perimeter surrounding the spiral portion in the insulating layer, a favorable magnetic path can be formed at the portion corresponding to the outer area of the spiral portion in the insulating layer. This secures a wide space in the inner area of the spiral portion, whereby the first insulation removing portion is not required to reduce its size. This allows the first and second insulation removing portions for forming a magnetic path to fully exhibit the effect of their close magnetic path structure, whereby the common-mode choke coil can reliably increase its impedance.

Preferably, a plurality of insulating layers are laminated so as to alternate with the coil conductors, whereas all the insulating layers except for the lowermost insulating layer are provided with the first and second insulation removing portions. In most of common-mode choke coils, the lowermost insulating layers in their layer structures are not formed with contact holes for electrically connecting different conductor layers to each other. Therefore, the structure in which the lowermost insulating layer is free of the first and second insulation removing portions makes it unnecessary to subject this insulating layer to boring and the like at all, whereby the number of man-hours can be reduced.

Preferably, a plurality of insulating layers are laminated so as to alternate with the coil conductors, whereas all the insulating layers are provided with the first and second insulation removing portions. This increases the area of magnetic paths in the insulating layers, so that the first and second insulation removing portions exhibit the effect of their close magnetic path structure to the maximum, whereby the common-mode choke coil can further increase its impedance.

Preferably, respective portions corresponding to four corners of the substantially square virtual perimeter in the insulating layer are provided with second insulation removing portions. This also increases the area of magnetic paths in the insulating layers, whereby the common-mode choke coil can further increase its impedance.

Preferably, the first insulation removing portion has a circular cross section. Since the spiral portion has a substantially circular inner periphery, the first insulation removing portion can most efficiently utilize the wide space of the inner area of the spiral portion when formed with a circular cross section. This can further increase the impedance of the common-mode choke coil.

Preferably, the second insulation removing portion has a triangular cross section or a cross section partly having a curve conforming to an outer periphery of the spiral portion. This allows the second insulation removing portion to utilize a free space in the outer area of the spiral portion efficiently, whereby the common-mode choke coil can further increase its impedance.

The present invention can improve the high-frequency characteristic of the common-mode choke coil. This can realize a high transmission characteristic when performing high-speed data transmission, for example.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

In the following, preferred embodiments of the present invention will be explained in detail with reference to the accompanying drawings. In the explanation, constituents identical to each other or those having functions identical to each other will be referred to with numerals identical to each other without repeating their overlapping descriptions.

First Embodiment

Figure 1:
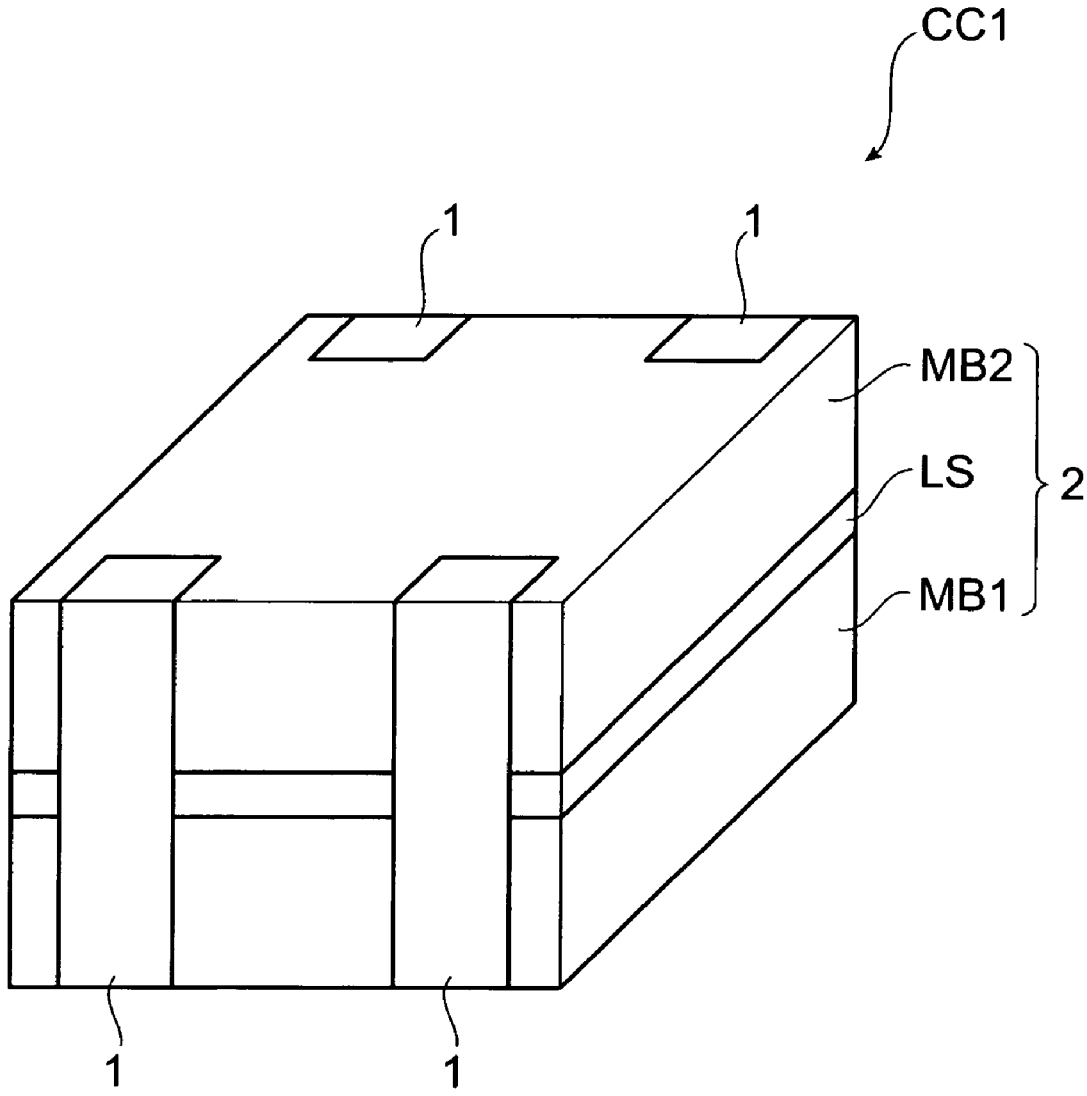
FIG. 1 is a perspective view showing a common-mode choke coil in accordance with a first embodiment.
Figure 2:
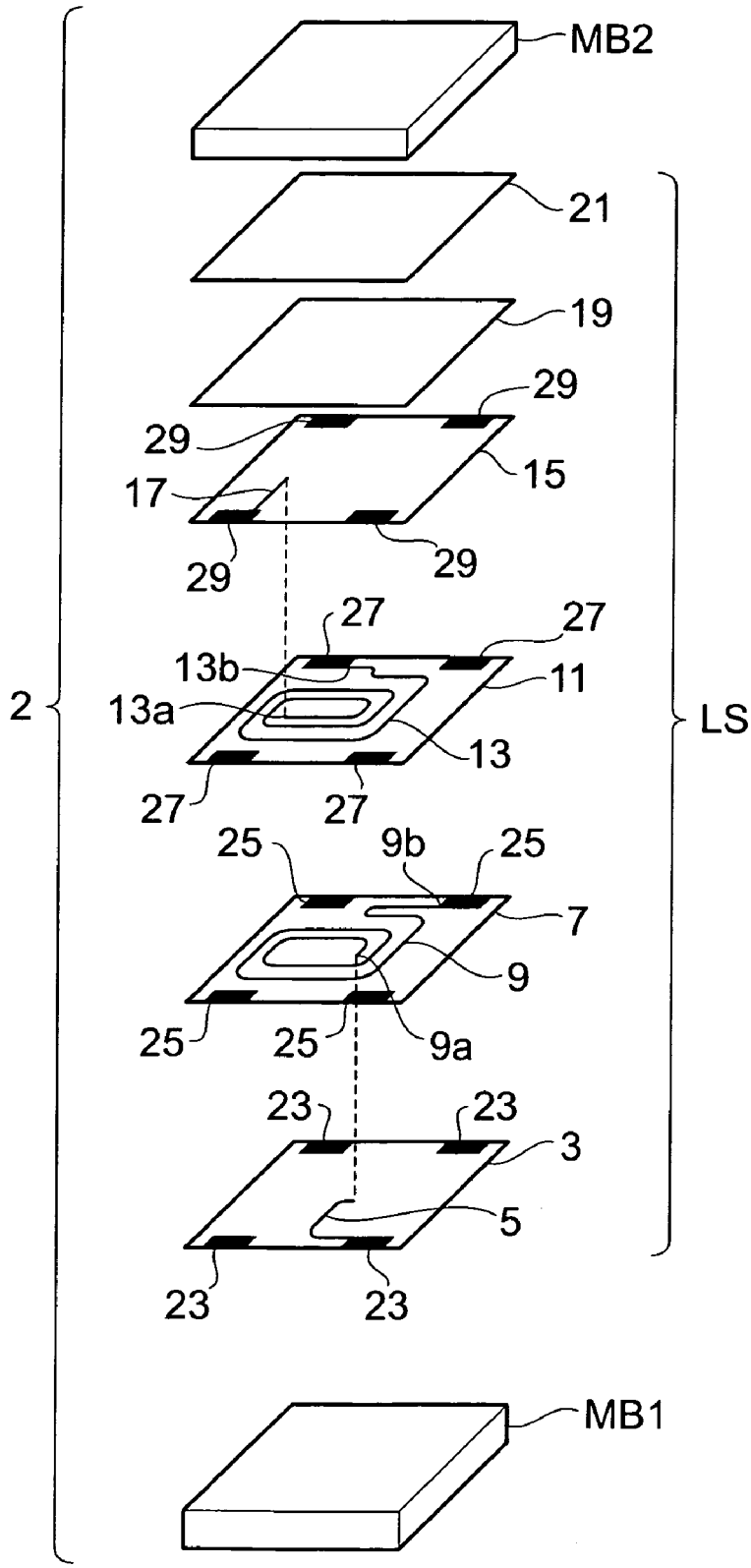
FIG. 2 is an exploded perspective view of a element shown in FIG. 1.
Figure 3:
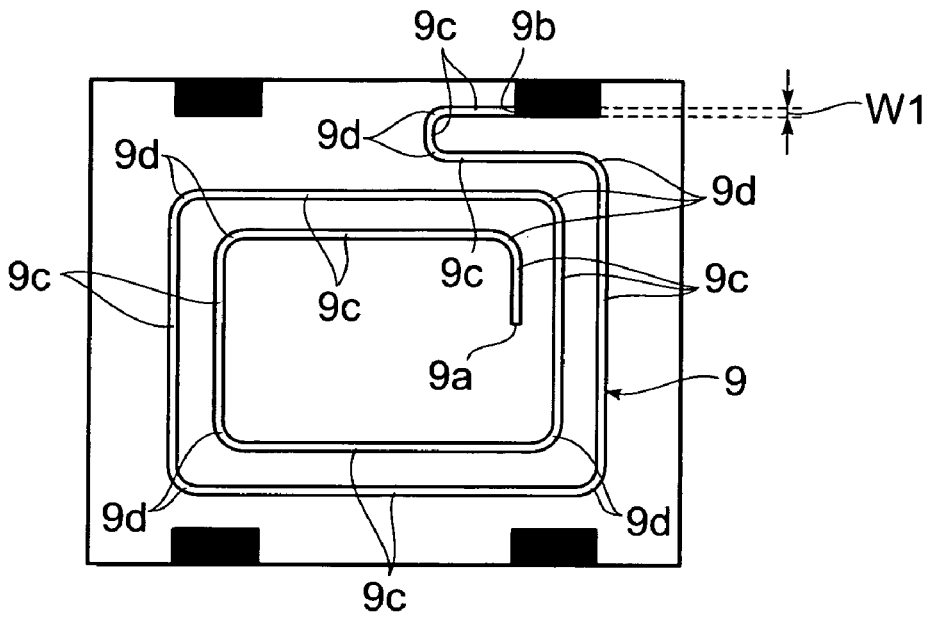
FIG. 3 is a plan view for explaining structures of first and second coil conductors.
Figure 3:
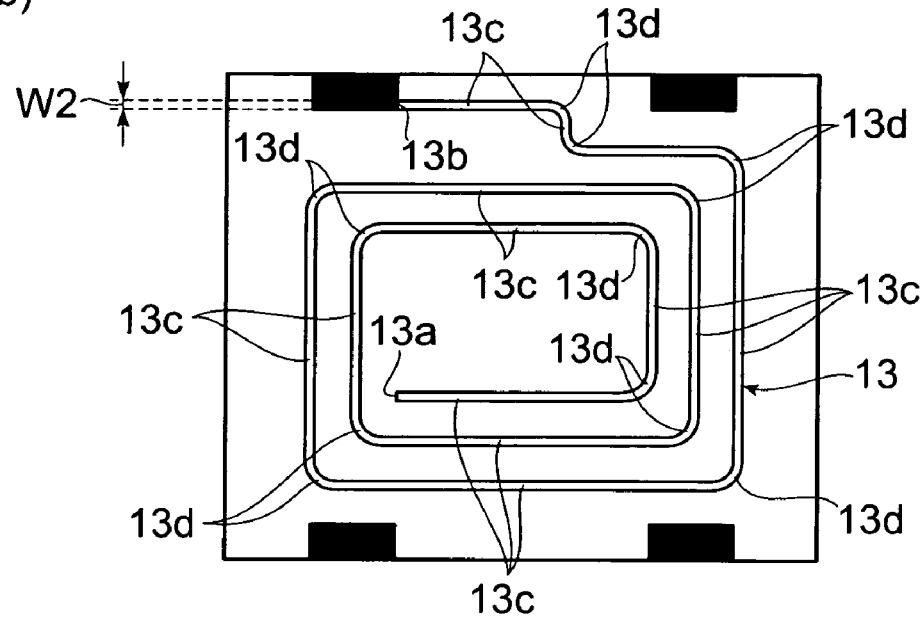

With reference to FIGS. 1 to 3, a common-mode choke coil CC1 in accordance with a first embodiment will be explained. FIG. 1 is a perspective view showing the common-mode choke coil in accordance with the first embodiment. FIG. 2 is an exploded perspective view of an element shown in FIG. 1. FIG. 3 is a plan view for explaining structures of first and second coil conductors. In FIG. 3, (a) shows the structure of the first coil conductor. In FIG. 3, (b) shows the structure of the second coil conductor.

As shown in FIG. 1, the common-mode choke coil CC1 is a common-mode choke coil of a thin-film type and has a rectangular parallelepiped form. The common-mode choke coil CC1 comprises terminal electrodes 1 and an element 2. The terminal electrodes 1 are provided on side faces of the element 2. The element 2 includes a first magnetic substrate MB1 and a second magnetic substrate MB2 as a pair of magnetic bodies, and a layer structure LS. The structure of the element 2 will now be explained.

Each of the first magnetic substrate MB1 and second magnetic substrate MB2 is a substrate made of a magnetic material such as sintered ferrite or composite ferrite (resin containing powdery ferrite).

As shown in FIG. 2, the layer structure LS includes a first insulating layer 3, a first lead portion 5, a second insulating layer 7, a first coil conductor 9, a third insulating layer 11, a second coil conductor 13, a fourth insulating layer 15, a second lead portion 17, a fifth insulating layer 19, and a bonding layer 21.

The first insulating layer 3 is made of a resin material (e.g., polyimide resin or epoxy resin) which is excellent in electric and magnetic insulation while having a favorable processability. The first insulating layer 3 acts to absorb irregularities of the first magnetic substrate MB1, so as to improve the adhesion to conductors such as the first lead portion 5. The first insulating layer 3 is provided with a cutout portion for exposing an end portion of the first portion 5. The first insulating layer 3 is formed as follows. First, the above-mentioned resin material is applied onto the first magnetic substrate MB1. Subsequently, thus applied resin material is exposed to light and developed, so as to be cured while in a state formed with cutout portions and the like at predetermined positions. The resin material may be applied by spin coating, dipping, spraying, or the like.

The first lead portion 5 is formed on the first insulating layer 3. One end of the first lead portion 5 is electrically connected to an inner end portion 9*a* of the spiral of the first coil conductor 9. The other end of the first lead portion 5 is exposed.

As with the first insulating layer 3, the second insulating layer 7 is made of a resin material (e.g., polyimide resin or epoxy resin) which is excellent in electric and magnetic insulation while having a favorable processability. The second insulating layer 7 is provided with a cutout portion for exposing an end portion of the first coil conductor 9. The second insulating layer 7 is formed on the first insulating layer 3 and first lead portion 5 by the same technique as that for the first insulating layer 3.

The first coil conductor 9 is formed on the second insulating layer 7. The first coil conductor 9 contains an electrically conductive metal material (e.g., Cu). As shown in (a) of FIG. 3, the first coil conductor 9 has a spiral form constituted by linear portions 9*c* and bent portions 9*d*. The bent portions 9*d* are portions connecting the linear portions 9*c* to each other. The bent portions 9*d* are flexed by a predetermined curvature, so as to become curves. The outer end portion 9*b* of the first coil conductor 9 is exposed.

The first coil conductor 9 is formed in the following manner. A conductor thin film is formed on the second insulating layer 7, and a pattern of the first coil conductor 9 is formed thereon by photolithography. Alternatively, a resist film may be formed after forming a base conductor film, a mold corresponding to the pattern of the first coil conductor 9 may be formed on the resist film by photolithography, and a conductive metal material may be grown by electroplating within the mold, so as to form the first coil conductor 9. The resist film used as the mold and the exposed base conductor film are removed.

The second insulating layer 7 is formed with a contact hole for bringing the first coil conductor 9 formed on the second insulating layer 7 into electric contact with the first lead portion 5 formed on the first insulating layer 3.

As with the first and second insulating layers 3, 7, the third insulating layer 11 is made of a resin material (e.g., polyimide resin or epoxy resin) which is excellent in electric and magnetic insulation while having a favorable processability. The third insulating layer 11 is provided with a cutout portion for exposing an end portion of the second coil conductor 13. The third insulating layer 11 is formed on the second insulating layer 7 and first coil conductor 9 by the same technique as that for the first insulating layer 3.

The second coil conductor 13 is formed on the third insulating layer 11. The second coil conductor 13 contains an electrically conductive metal material (e.g., Cu). The second coil conductor 13 has substantially the same inductance value as that of the first coil conductor 9, and a total length slightly longer than that of the first coil conductor 9. As shown in (b) of FIG. 3, the second coil conductor 13 has a spiral form constituted by linear portions 13*c* and bent portions 13*d*. The bent portions 13*d* are portions connecting the linear portions 13*c* to each other. The bent portions 13*d* are flexed by a predetermined curvature, so as to become curves. The outer end portion 13*b* of the second coil conductor 13 is exposed. The second coil conductor 13 is formed by the same technique as that for the first coil conductor 9.

The third insulating layer 11 is formed with a contact hole for bringing the second coil conductor 13 formed on the third insulating layer 11 into electric contact with the second lead portion 17 formed on the fourth insulating layer 15.

As with the first to third insulating layers 3, 7, 11, the fourth insulating layer 15 is made of a resin material (e.g., polyimide resin or epoxy resin) which is excellent in electric and magnetic insulation while having a favorable processability. The fourth insulating layer 15 is provided with a cutout portion for exposing an end portion of the lead portion 17. The fourth insulating layer 15 is formed on the third insulating layer 11 and second coil conductor 13 by the same technique as that for the first insulating layer 3.

The second lead portion 17 is formed on the fourth insulating layer 15. One end of the second lead portion 17 is electrically connected to the inner end portion 13*a* of the second coil conductor 13. The other end of the second lead portion 17 is exposed.

The fourth insulating layer 15 is formed with a contact hole for bringing the second coil conductor 13 formed on the third insulating layer 11 into electric contact with the second lead portion 17 formed on the fourth insulating layer 15.

As with the first to fourth insulating layers 3, 7, 11, 15, the fifth insulating layer 19 is made of a resin material (e.g., polyimide resin or epoxy resin) which is excellent in electric and magnetic insulation while having a favorable processability. The fifth insulating layer 19 is formed on the fourth insulating layer 15 and second lead portion 17 by the same technique as that for the first insulating layer 3.

The bonding layer 21 is constituted by an adhesive (e.g., epoxy resin, polyimide resin, or polyamide resin). The bonding layer 21 is formed on the fifth insulating layer 19, and bonds the second magnetic substrate MB2 to the fifth insulating layer 19.

The first insulating layer 3 is formed with cutout portions at respective positions corresponding to the end portions 9*b*, 13*b* of the first and second coil conductors 9, 13 and the end portion of the second lead portion 17, whereas the cutout portions are provided with respective conductors 23 electrically connected to these end portions. The second insulating layer 7 is formed with cutout portions at respective positions corresponding to the end portion 13*b* of the second coil conductor 13 and the end portions of the first and second lead portions 5, 17, whereas the cutout portions are provided with respective conductors 25 electrically connected to these end portions. The third insulating layer 11 is formed with cutout portions at respective positions corresponding to the end portion 9*b* of the first coil conductor 9 and the end portions of the first and second lead portions 5, 17, whereas the cutout portions are provided with respective conductors 27 electrically connected to these end portions. The fourth insulating layer 15 is formed with cutout portions at respective positions corresponding to the end portions 9*b*, 13*b* of the first and second coil conductors 9, 13 and the end portion of the first lead portion 5, whereas the cutout portions are provided with respective conductors 29 electrically connected to these end portions.

The first and second coil conductors 9, 13 and the first and second lead portions 5, 17 are electrically in contact with their corresponding terminal electrodes 1. The terminal electrodes 1 are made by forming a Cr/Cu film or Ti/Cu film by mask sputtering and then electroplating this film with Ni/Sn.

In thus configured common-mode choke coil CC1, the first coil conductor 9 and second coil conductor 13 are laminated with the third insulating layer 11 interposed therebetween. This magnetically couples the first coil conductor 9 and second coil conductor 13 to each other.

The coil conductor having a shorter total length in the first coil conductor 9 and second coil conductor 13, i.e., the first coil conductor 9, has a conductor width W1 (mm) and a total length L1 (mm) satisfying the relationship represented by the following expression (1):

$$\sqrt{L1/W1} < (7.6651 - fc)/0.1385 \quad (1)$$

Here, the total length L1 of the first coil conductor 9 is the conductor length from the inner end portion 9*a* of the spiral of the first coil conductor 9 to the outer end portion 9*b* of the spiral.

Though the first coil conductor 9 satisfies the relationship represented by the above-mentioned expression (1) in this embodiment, the second coil conductor 13 may have a conductor width W2 (mm) and a total length L2 (mm) satisfying the relationship represented by the following expression (2):

$$\sqrt{L2/W2}<(7.6651-fc)/0.1385 \quad (2)$$

Expression (2) substitutes W1 and L1 in expression (1) with the conductor width W2 and total length L2 of the second coil conductor 13, respectively. The total length L2 of the second coil conductor 13 is the conductor length from the inner end portion 13*a* of the spiral of the second coil conductor 13 to the outer end portion 13*b* of the spiral.

Figure 4:
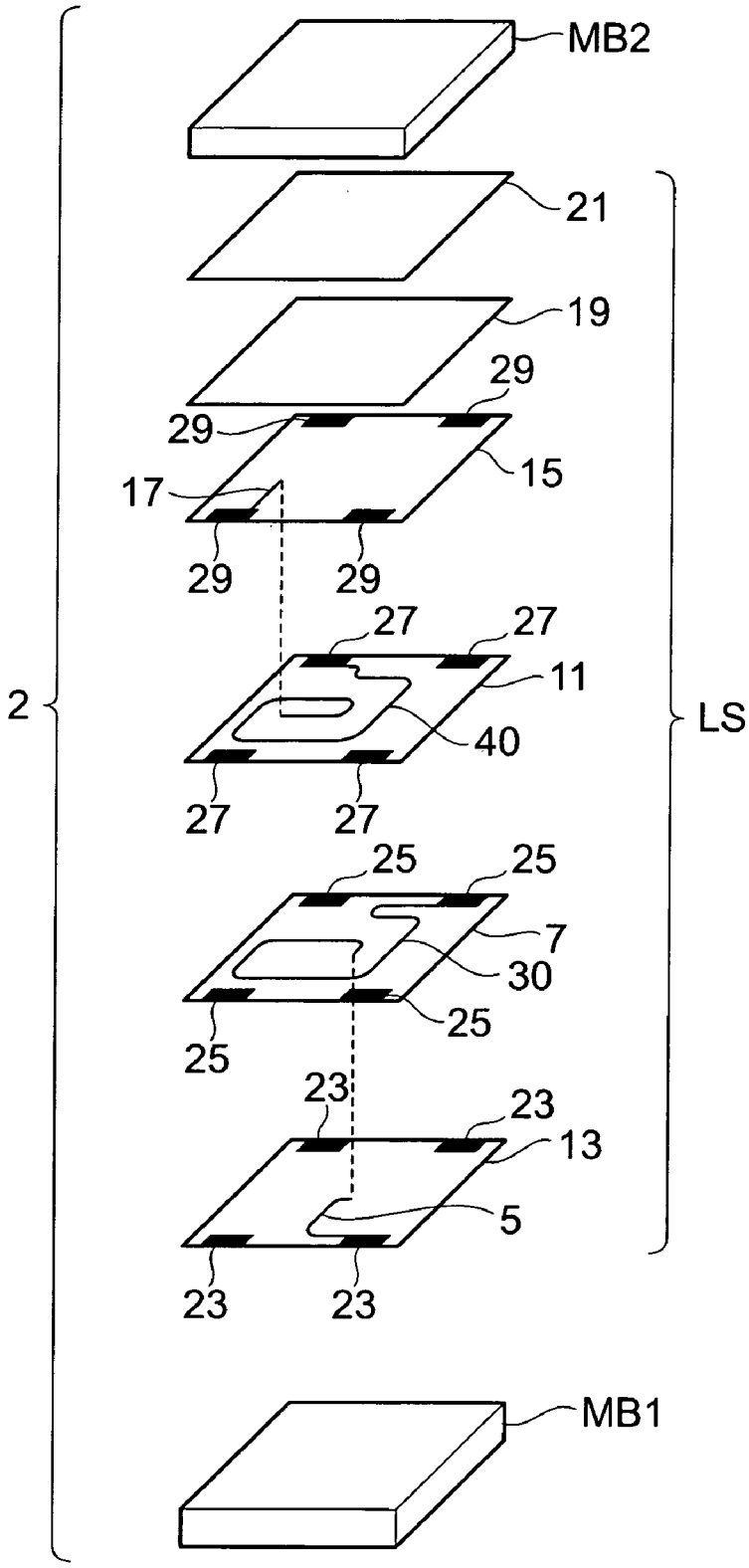
FIG. 4 is an exploded perspective view showing an element provided in an evaluated common-mode choke coil.
Figure 5:
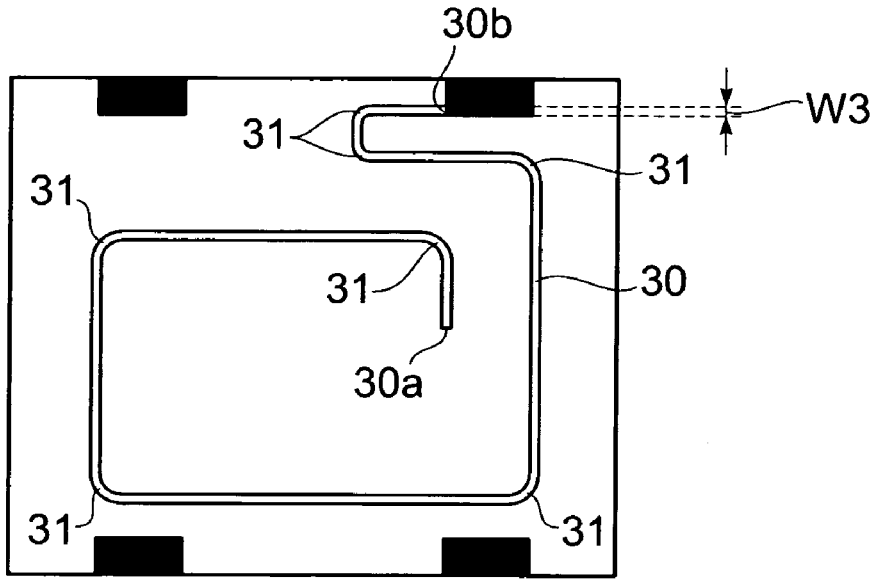
FIG. 5 is a plan view for explaining a structure of a first coil conductor in the element shown in FIG. 4.

Grounds for the above-mentioned expression (1) will now be explained. The above-mentioned expression (1) is obtained according to results of evaluation of a common-mode choke coil having the same structure as that of the common-mode choke coil CC1. FIG. 4 is an exploded perspective view showing an element provided in the evaluated common-mode choke coil. FIG. 5 is a plan view for explaining a structure of a first coil conductor in the element shown in FIG. 4.

As shown in FIG. 4, an element 2 provided in the evaluated common-mode choke coil includes a first magnetic substrate MB1, a second magnetic substrate MB2, a first insulating layer 3, a first lead portion 5, a second insulating layer 7, a third insulating layer 11, a fourth insulating layer 15, a second lead portion 17, a fifth insulating layer 19, and a bonding layer 21. The evaluated common-mode choke coil has a first coil conductor 30 and a second coil conductor 40. The first coil conductor 30 corresponds to the first coil conductor 9 in the common-mode choke coil CC1. The second coil conductor 40 corresponds to the second coil conductor 13 in the common-mode choke coil CC1. The second coil conductor 40 has substantially the same inductance value as that of the first coil conductor 30, and a total length slightly longer than that of the first coil conductor 30.

Figure 6:
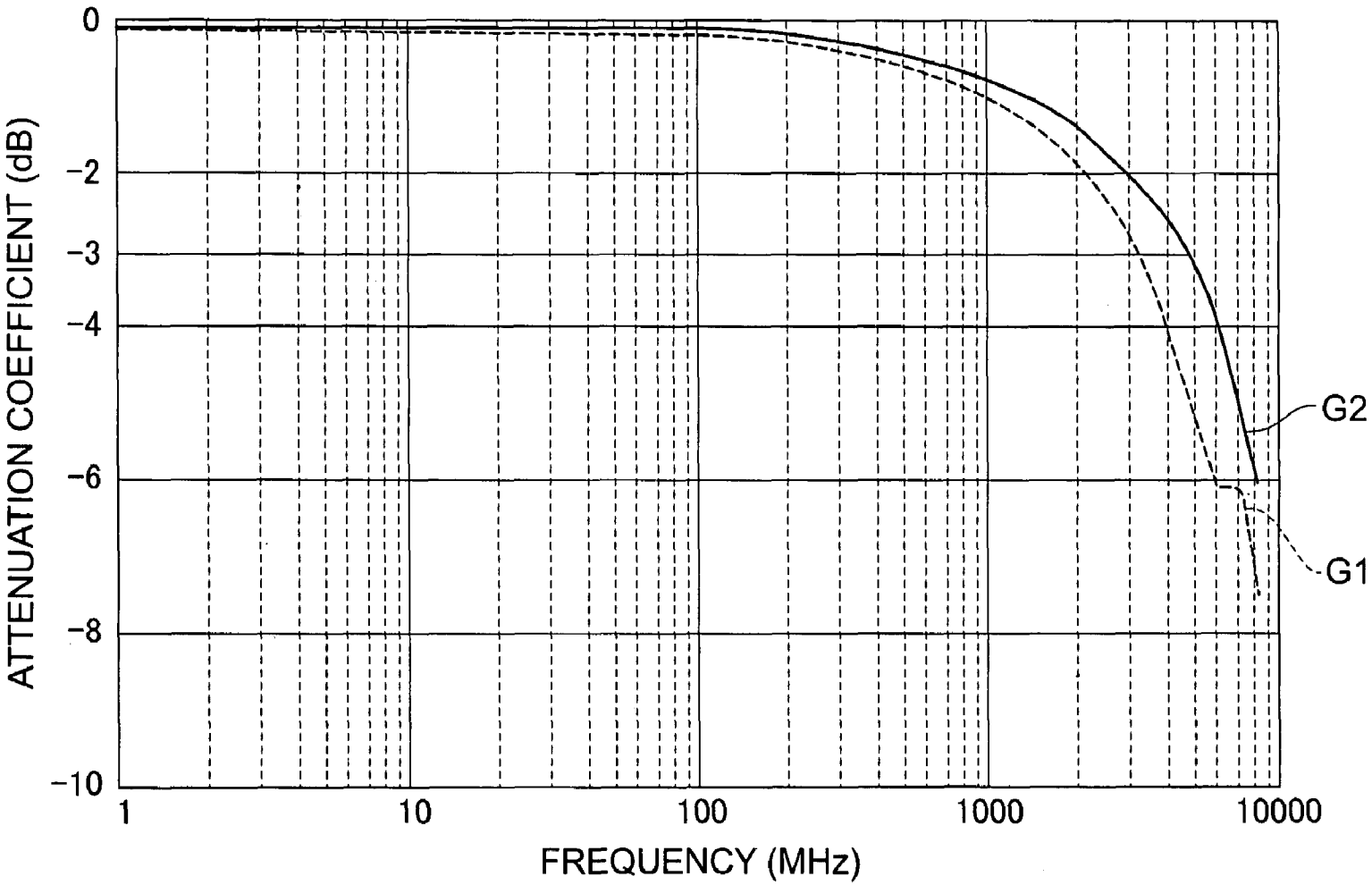
FIG. 6 is a graph showing attenuation characteristics obtained when a conductor width and a total length of the first coil conductor are changed.
Figure 7:
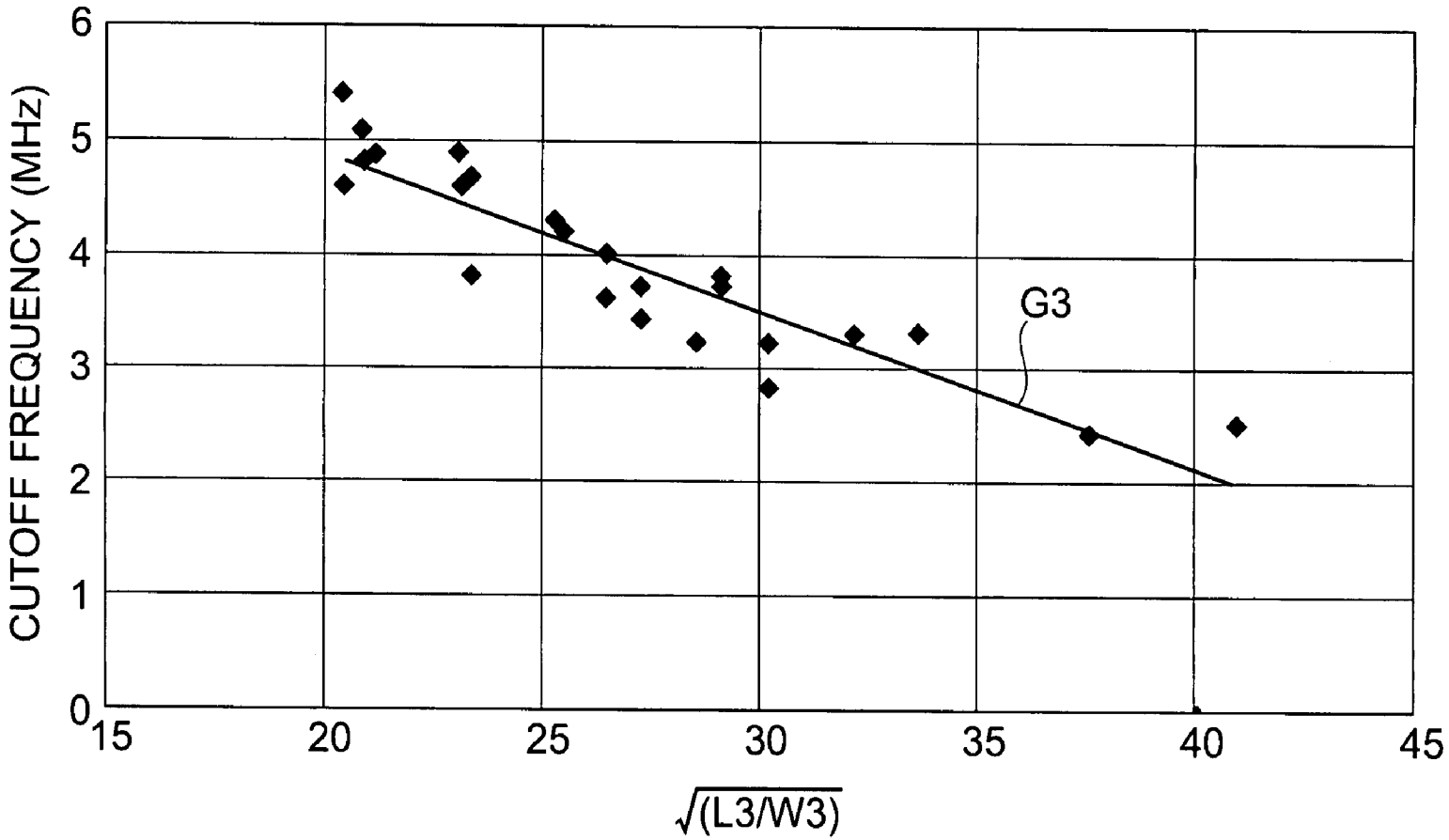
FIG. 7 is a graph showing the relationship between a conductor width and a total length of the first coil conductor and a cutoff frequency.

The first coil conductor 30 has a conductor width W3 (mm) and a total length L3 (mm). The total length L3 is the conductor length from the inner end portion 30*a* of the spiral of the third coil conductor 30 to the outer end portion 30*b* of the spiral. While changing the conductor width W3 and total length L3, the attenuation characteristic of the common-mode choke coil with respect to differential mode noise was studied. FIG. 6 shows thus obtained results. Characteristic G1 is a curve obtained when the value of $\sqrt{L3/W3}$ was 30.2, where the cutoff frequency was about 3.2 GHz. Characteristic G2 is a curve obtained when the value of $\sqrt{L3/W3}$ was 23.2, where the cutoff frequency was about 4.9 GHz. While varying the value of $\sqrt{L3/W3}$ in such a manner, the value of $\sqrt{L3/W3}$ at which the cutoff frequency became high was investigated. FIG. 7 is a graph showing thus obtained results.

As indicated by line G3 in FIG. 7, the conductor width W3 and total length L3 of the first coil conductor 30 and the cutoff frequency fc were seen to satisfy the relationship represented by the following expression (3):

$$\sqrt{L3/W3}<(7.6651-fc)/0.1385 \quad (3)$$

when the cutoff frequency fc was high (about 2 to 5 MHz).

The evaluated common-mode choke coil and the common-mode choke coil CC1 have the same structure. Therefore, expression (3) shows that the common-mode choke coil CC1 also attains a high cutoff frequency fc when the conductor width W and total length L of the first coil conductor 9 and the cutoff frequency fc satisfy the relationship represented by the above-mentioned expression (1).

In order for a common-mode choke coil to operate at a high frequency, it has been considered necessary for the cutoff frequency to be at least about three times the transmission frequency. In view of fluctuations among products and the like, it is desirable for the cutoff frequency to be at least about five times the transmission frequency. When the transmission frequency is about 800 MHz, for example, the desirable cutoff frequency is about 4 GHz or higher. The above-mentioned expression (1) shows that, for attaining a cutoff frequency fc of 4 GHz or higher, the conductor width W (mm) and total length L (mm) of the first coil conductor 9 satisfies the relationship of:

$$\sqrt{L/W}<26.5 \quad (4)$$

Grounds for flexing the bent portions 9*d* of the first coil conductor 9 at a predetermined curvature will now be explained. They are based on results of evaluation of a common-mode choke coil comprising the element 2 shown in FIG. 4. As shown in FIG. 7 and expression (3), the value of cutoff frequency becomes higher as the value of $\sqrt{L3/W3}$ is smaller in the common-mode choke coil comprising the element 2 shown in FIG. 4. For reducing the value of $\sqrt{L3/W3}$, there may be two techniques, i.e., one increasing W3 without changing L3 and one decreasing L3 without changing W3.

First, the technique of increasing W3 without changing L3 will be studied. As W3 is made greater without changing L3, the third coil conductor 30 becomes greater. When the third coil conductor 30 becomes greater, the insulating layer where the third coil conductor 30 is formed must be made greater. This makes it necessary to increase the size of the common-mode choke coil. Since the common-mode choke coil is preferably made with a smaller size, the technique of increasing W3 without changing L3 is not effective.

The technique of decreasing L3 without changing W3 will now be studied. One of methods for shortening L2 reduces the number of windings of the spiral. However, reducing the number of windings decreases the common-mode impedance. As a consequence, the technique of shortening L3 by reducing the number of windings is not effective.

Therefore, as shown in FIG. 5, the bent portions 31 of the third coil conductor 30 are flexed by a predetermined curvature, so as to form curves. The bent portions can be made shorter when formed as curves than when formed by lines. Consequently, the total length L3 of the third coil conductor 30 can be made shorter, whereby the common-mode choke coil can attain a high cutoff frequency fc.

The evaluated common-mode choke coil and the common-mode choke coil CC1 have the same structure. Therefore, it is clear that the common-mode choke coil CC1 can also attain a high cutoff frequency fc without increasing its size if the bent portions 9*d* of the first coil conductor 9 are flexed by a predetermined curvature.

In this embodiment, as in the foregoing, the total length L1 of the first coil conductor 9 is shortened so as to satisfy the relationship represented by the above-mentioned expression (1), whereby the cutoff frequency fc becomes high. Since the cutoff frequency fc is high, the transmission frequency at which the common-mode choke coil CC1 can operate normally can be raised. Consequently, the common-mode choke coil CC1 can be obtained with a favorable high-frequency characteristic.

Second Embodiment

Figure 8:
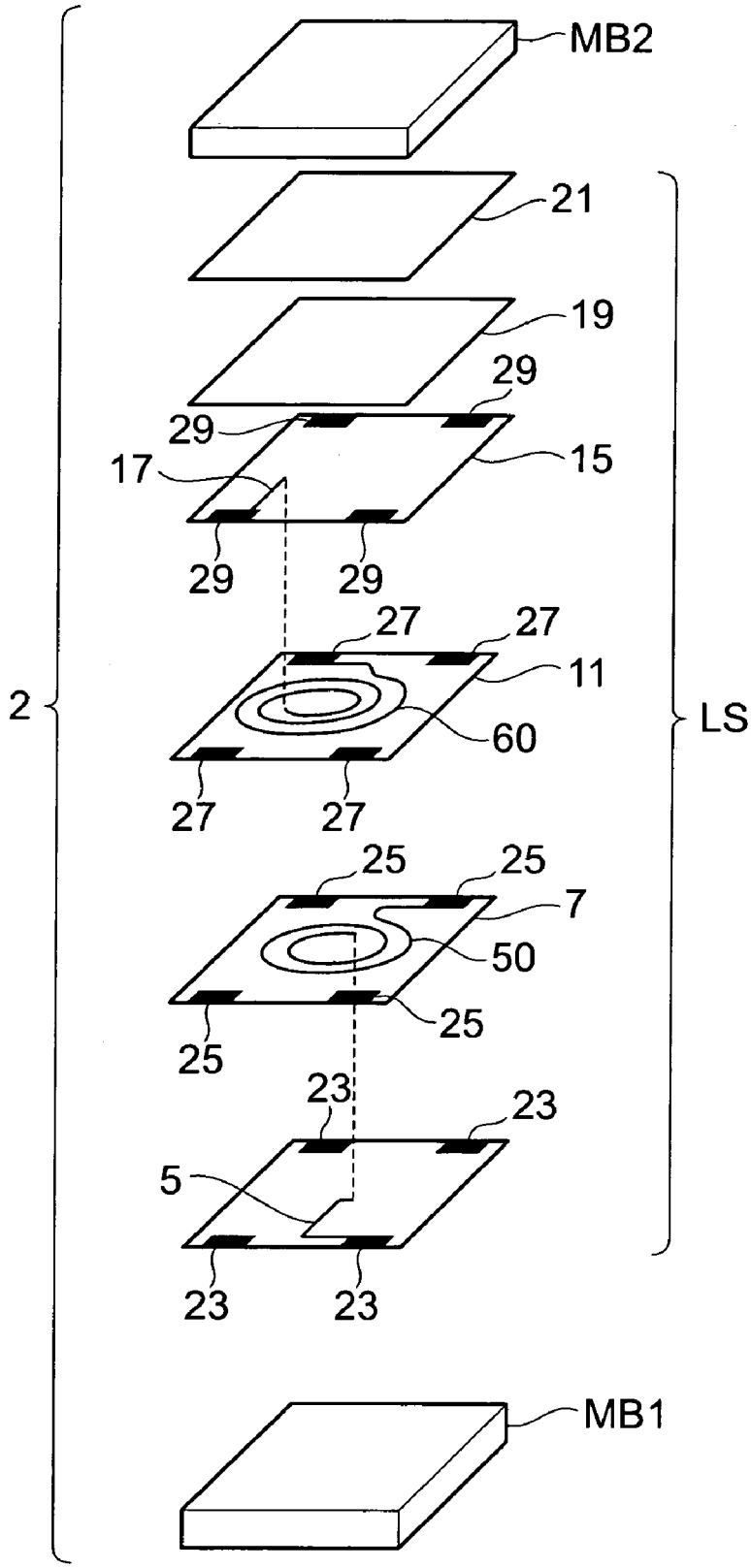
FIG. 8 is an exploded perspective view showing a common-mode choke coil in accordance with a second embodiment.
Figure 9:
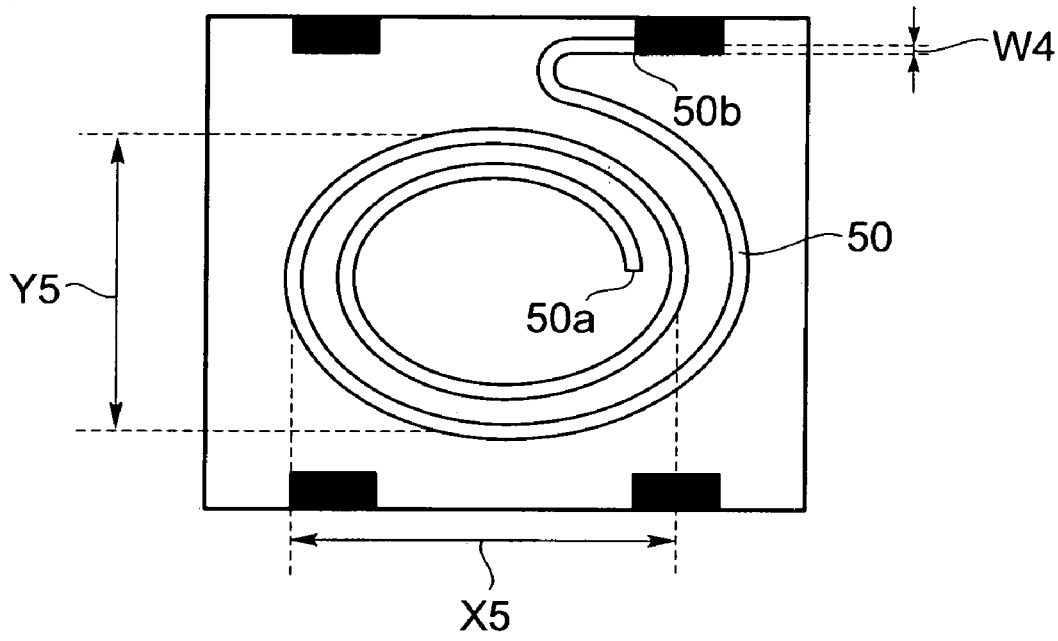
FIG. 9 is a plan view for explaining structures of first and second coil conductors.
Figure 9:
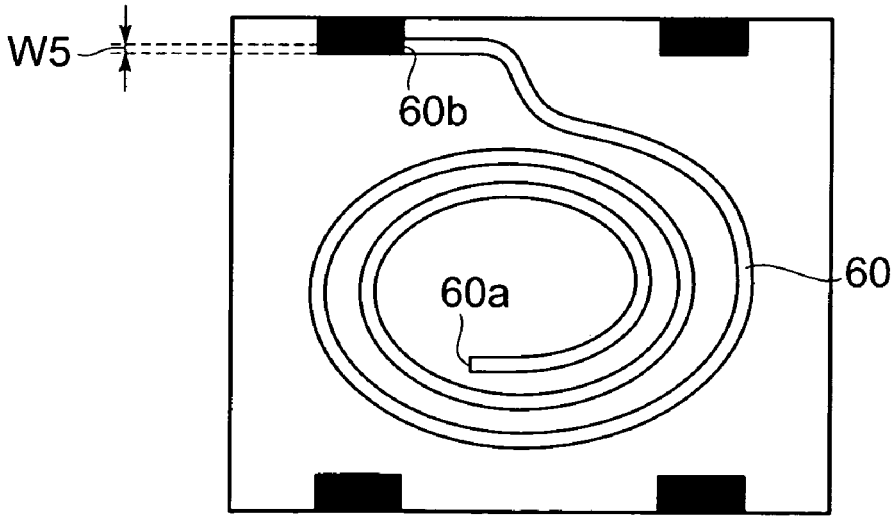

A common-mode choke coil in accordance with a second embodiment will now be explained with reference to FIGS. 8 and 9. FIG. 8 is an exploded perspective view of an element provided in the common-mode choke coil in accordance with the second embodiment. FIG. 9 is a plan view for explaining structures of first and second coil conductors. In FIG. 9, (a) shows the structure of the first coil conductor. In FIG. 9, (b) shows the structure of the second coil conductor.

The common-mode choke coil in accordance with the second embodiment comprises terminal electrodes 1 and an element 2. As shown in FIG. 8, the element 2 includes a first magnetic substrate MB1, a second magnetic substrate MB2, a first insulating layer 3, a first lead portion 5, a second insulating layer 7, a third insulating layer 11, a fourth insulating layer 15, a second lead portion 17, a fifth insulating layer 19, and a bonding layer 21. The element 2 has a first coil conductor 50 and a second coil conductor 60. The first coil conductor 50 corresponds to the first coil conductor 9 in the common-mode choke coil CC1. The second coil conductor 60 corresponds to the second coil conductor 13 in the common-mode choke coil CC1. The fifth and sixth coil conductors 50, 60 differ from the first and second coil conductors 9, 13 in terms of their forms.

The first coil conductor 50 is formed by a curve as shown in (a) of FIG. 9. The second coil conductor 60 is formed by a curve as shown in (b) of FIG. 9. The second coil conductor 60 has substantially the same inductance value as that of the first coil conductor 50, and a total length slightly longer than that of the first coil conductor 50. The coil conductor having a longer total length in the first and second coil conductors 50, 60, i.e., the first coil conductor 50, has a conductor width W4 (mm) and a total length L4 (mm) satisfying the relationship represented by the following expression (4):

$$\sqrt{L4/W4}<(7.6651-fc)/0.1385 \quad (4)$$

Expression (4) substitutes W1 and L1 in expression (1) with the conductor width W4 and total length L4 of the first coil conductor 50, respectively. The total length L4 of the first coil conductor 50 is the conductor length from the inner end portion 50*a* of the spiral of the first coil conductor 50 to the outer end portion 50*b* of the spiral.

Though the first coil conductor 50 satisfies the relationship represented by expression (4) in this embodiment, the second coil conductor 60 may have a conductor width W5 (mm) and a total length L5 (mm) satisfying the relationship represented by the following expression (5):

$$\sqrt{L5/W5}<(7.6651-fc)/0.1385 \quad (5)$$

Expression (5) substitutes W4 and L4 in expression (4) with the conductor width W5 and total length L5 of the second coil conductor 60, respectively. The total length L5 of the second coil conductor 60 is the conductor length from the inner end portion 60*a* of the spiral of the second coil conductor 60 to the outer end portion 60*b* of the spiral.

Figure 10:
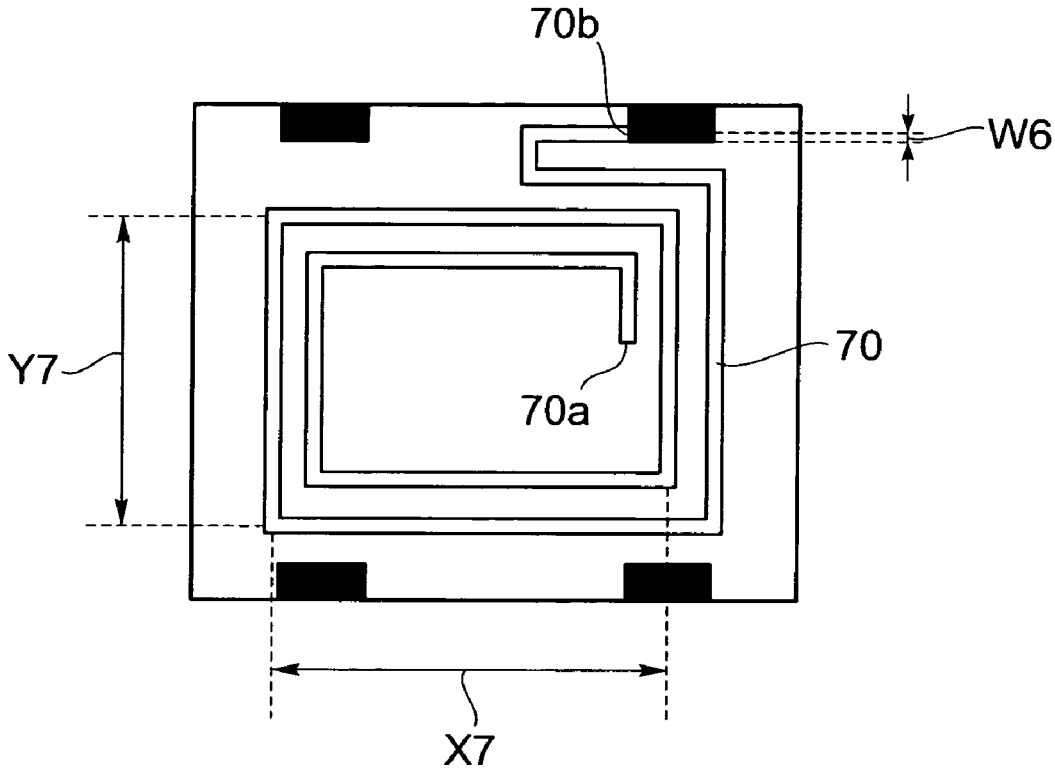
FIG. 10 is a plan view for explaining the structure of the first coil conductor.

The total length L4 of the first coil conductor 50 and the total length of a coil conductor 70 formed by lines alone (see FIG. 10) will now be compared with each other. The conductor width W6 of the coil conductor 70 is the same as the conductor width W4 of the first coil conductor 50. The lateral length X7 of the coil conductor 70 is the same as the length X5 in a lateral direction perpendicular to the laminating direction in the first coil conductor 50. The longitudinal length Y7 of the coil conductor 70 is the same value as the length Y5 in a longitudinal direction perpendicular to the laminating direction in the first coil conductor 50. While the total length of the coil conductor 70 (the length from one end 70*a* to the other end 70*b*) is 10.3 mm, the total length L4 of the first coil conductor 50 is 8.6 mm. Namely, the total length of the first coil conductor 50 is shorter than that of the coil conductor 70 by about 17%. When the total length of the coil conductor is shorter by about 17%, a common-mode choke coil using the first coil conductor 50 yields a cutoff frequency higher than that of a common-mode choke coil using the coil conductor 70 by about 5 to 10%. Thus, using the first coil conductor 50 formed by a curve can achieve a higher cutoff frequency.

Though the bent portions 9*d* of the first coil conductor 9 are curved in the first embodiment, portions other than the bent portions 9*d* may also be curved. In this case, it will be preferred if at least 50% of the total length of the first coil conductor 9 is curved. This can make the first coil conductor 9 shorter, whereby the cutoff frequency can become higher. The first coil conductor 9 curved over the total length thereof corresponds to the above-mentioned first coil conductor 50.

Though all the bent portions 9*d* of the first coil conductor 9 are curved in the first embodiment, a part of the bent portions 9*d* in the first coil conductor 9 may be curved alone.

Though the total length of the first coil conductor 9, 50 is made shorter than the total length of the second coil conductor 13, 60 in the first and second embodiments, the length of the first coil conductor 9, 50 may be the same as the total length of the second coil conductor 13, 60.

Third Embodiment

A common-mode choke coil CC2 in accordance with a third embodiment will now be explained in detail with reference to the drawings.

Figure 11:
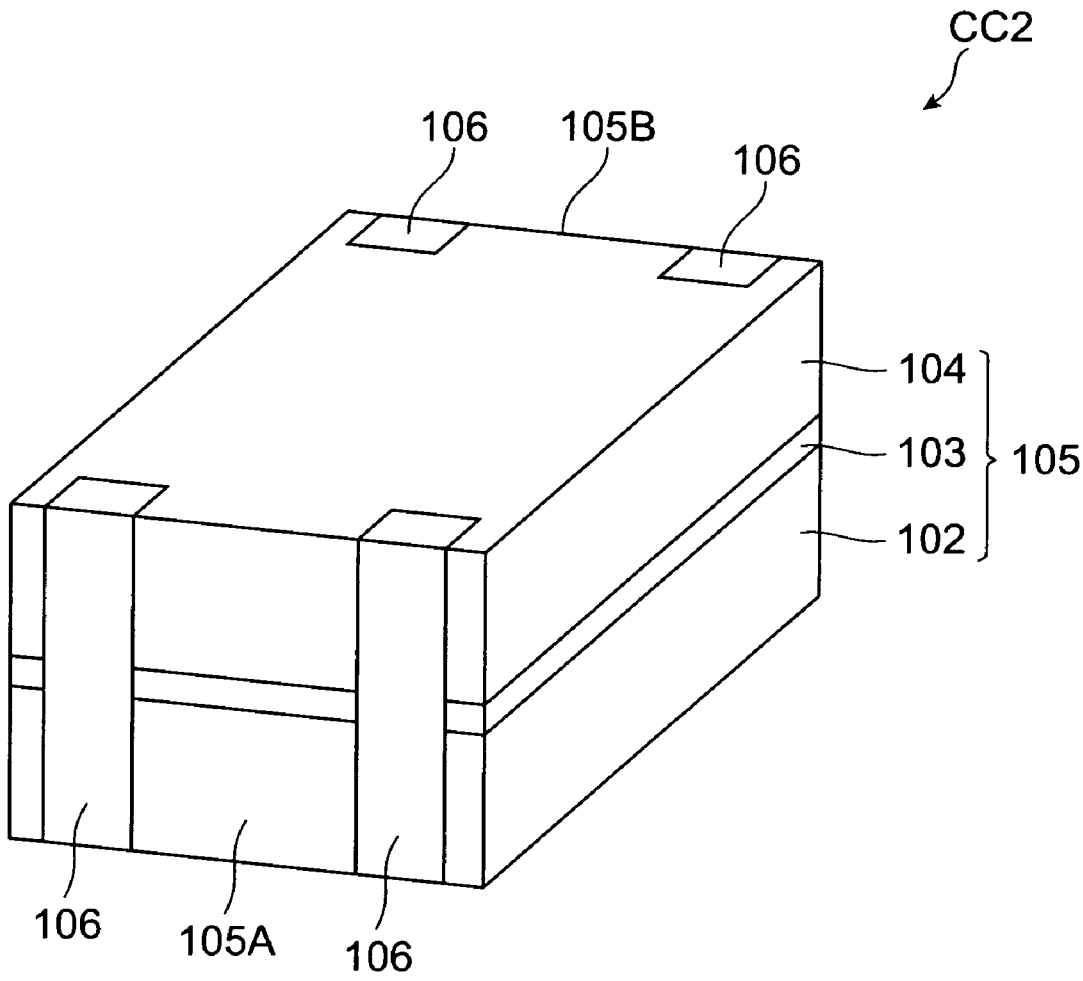
FIG. 11 is a perspective view showing a common-mode choke coil in accordance with a third embodiment.

FIG. 11 is a perspective view showing the common-mode choke coil CC2 in accordance with the third embodiment. The common-mode choke coil CC2 in accordance with this embodiment in the drawing is a common-mode choke coil of a thin film type having a rectangular parallelepiped form.

The common-mode choke coil CC2 comprises a multilayer body 105 constituted by a lower magnetic substrate 102, a layer structure 103, and an upper magnetic substrate 104; and four terminal electrodes 106 provided on side faces of the multilayer body 105. The layer structure 103 is arranged between the lower magnetic substrate 102 and upper magnetic substrate 104. Each of the lower magnetic substrate 102 and upper magnetic substrate 104 is a substrate made of a magnetic material such as sintered ferrite or composite ferrite (resin containing powdery ferrite).

Figure 12:
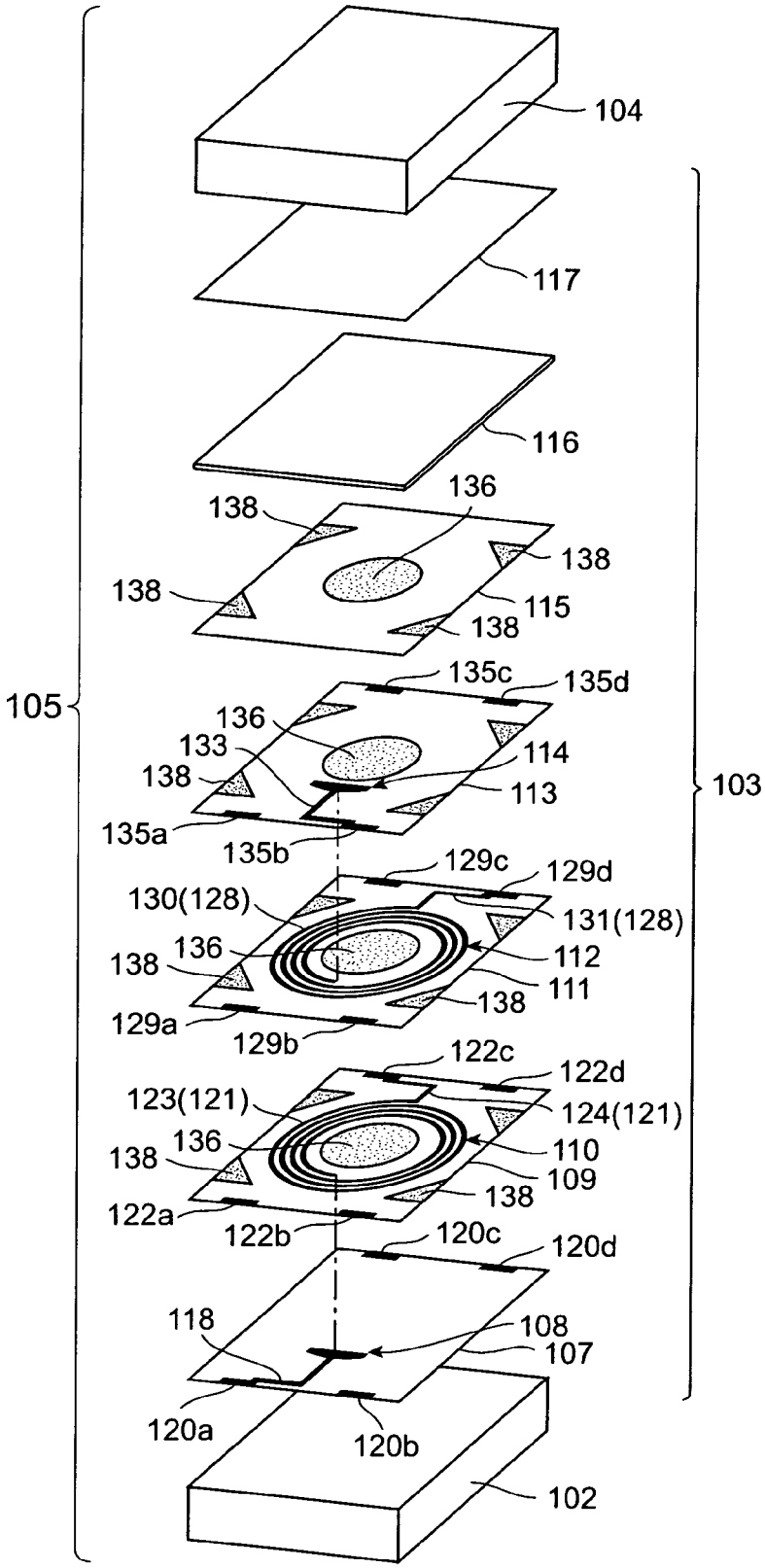
FIG. 12 is an exploded perspective view of an element shown in FIG. 11.

FIG. 12 is an exploded perspective view of the multilayer body 105. The layer structure 103 in this drawing comprises an insulating layer 107, a conductor layer 108, an insulating layer 109, a conductor layer 110, an insulating layer 111, a conductor layer 112, an insulating layer 113, a conductor layer 114, an insulating layer 115, a magnetic layer 116, and a bonding layer 117 which are successively laminated from the lower side.

The lowermost insulating layer 107 is a layer for attaining a favorable adhesion to the conductor layer 108 even if the upper face of the lower magnetic substrate 102 has irregularities. The insulating layer 107 is made of a resin material (e.g., polyimide resin or epoxy resin) which is excellent in electric and magnetic insulation while having a favorable processability.

Figure 13:
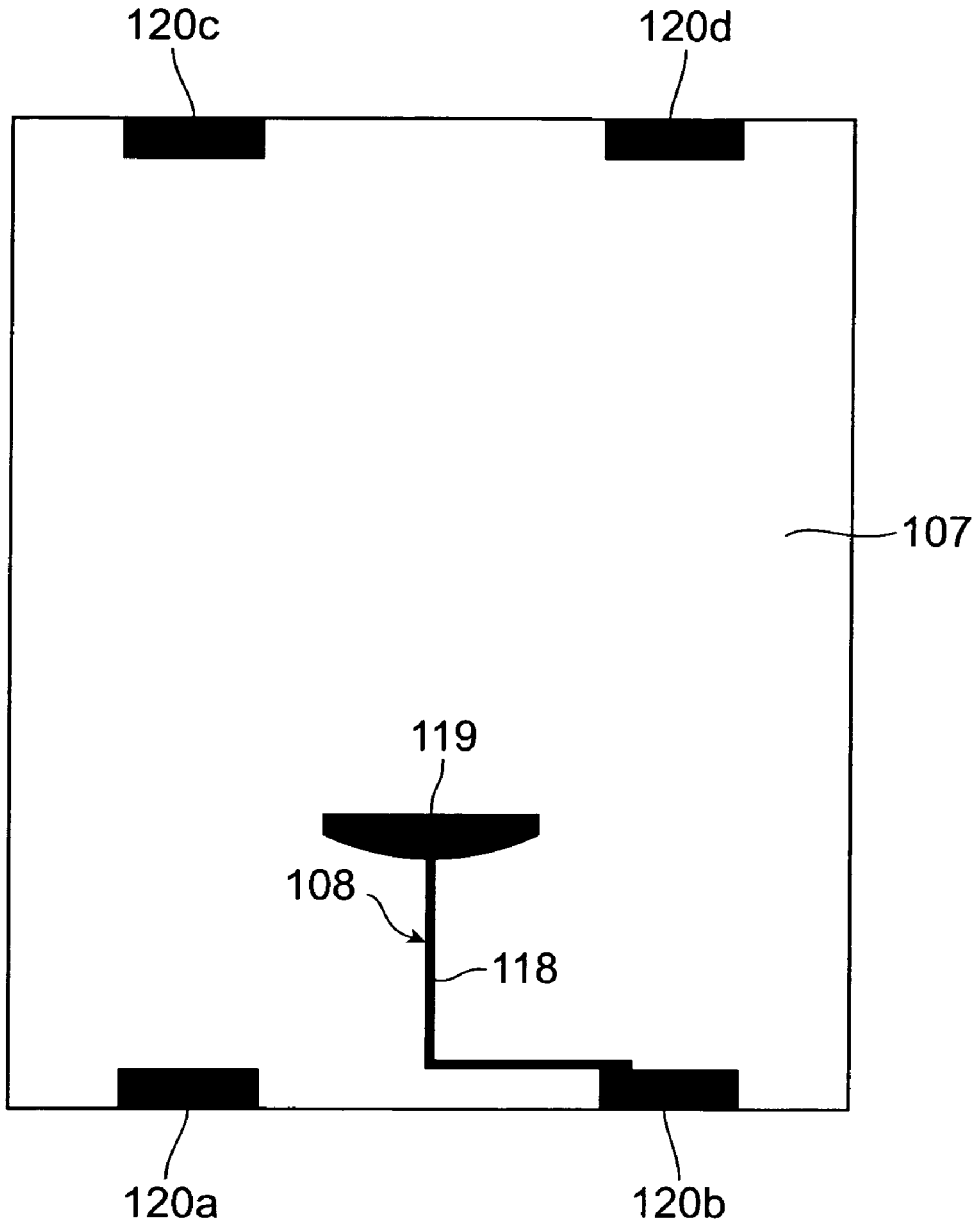
FIG. 13 is a plan view showing the lowermost insulating layer and the conductor layer formed thereon that are shown in FIG. 12.

The conductor layer 108 is formed on the insulating layer 107. As shown FIG. 13, the conductor layer 108 has a lead conductor 118, a connecting conductor 119, and lead electrodes 120*a* to 120*d*. The lead electrodes 120*a*, 120*b* are formed at one edge portion in the upper face of the insulating layer 107, whereas lead electrodes 120*c*, 120*d* are formed at the opposite edge portion in the upper face of the insulating layer 107 so as to oppose the lead electrodes 120*a*, 120*b*, respectively. The lead conductor 118 is formed like letter L. One end of the lead conductor 118 is connected to the lead electrode 120*a*, whereas the other end of the lead conductor 118 is connected to the connecting conductor 119. As a metal material for forming such a conductor layer 108, a metal excellent in electric conductivity, processability, and the like (e.g., Cu or Al) is preferably used.

The insulating layer 109 is formed on the conductor layer 108. The insulating layer 109 is made of the same resin material as that for the insulating layer 107. The insulating layer 109 is formed with a contact hole (not depicted) for electrically connecting a coil conductor 121 (to be explained later) of the conductor layer 110 to the connecting conductor 119.

Figure 14:
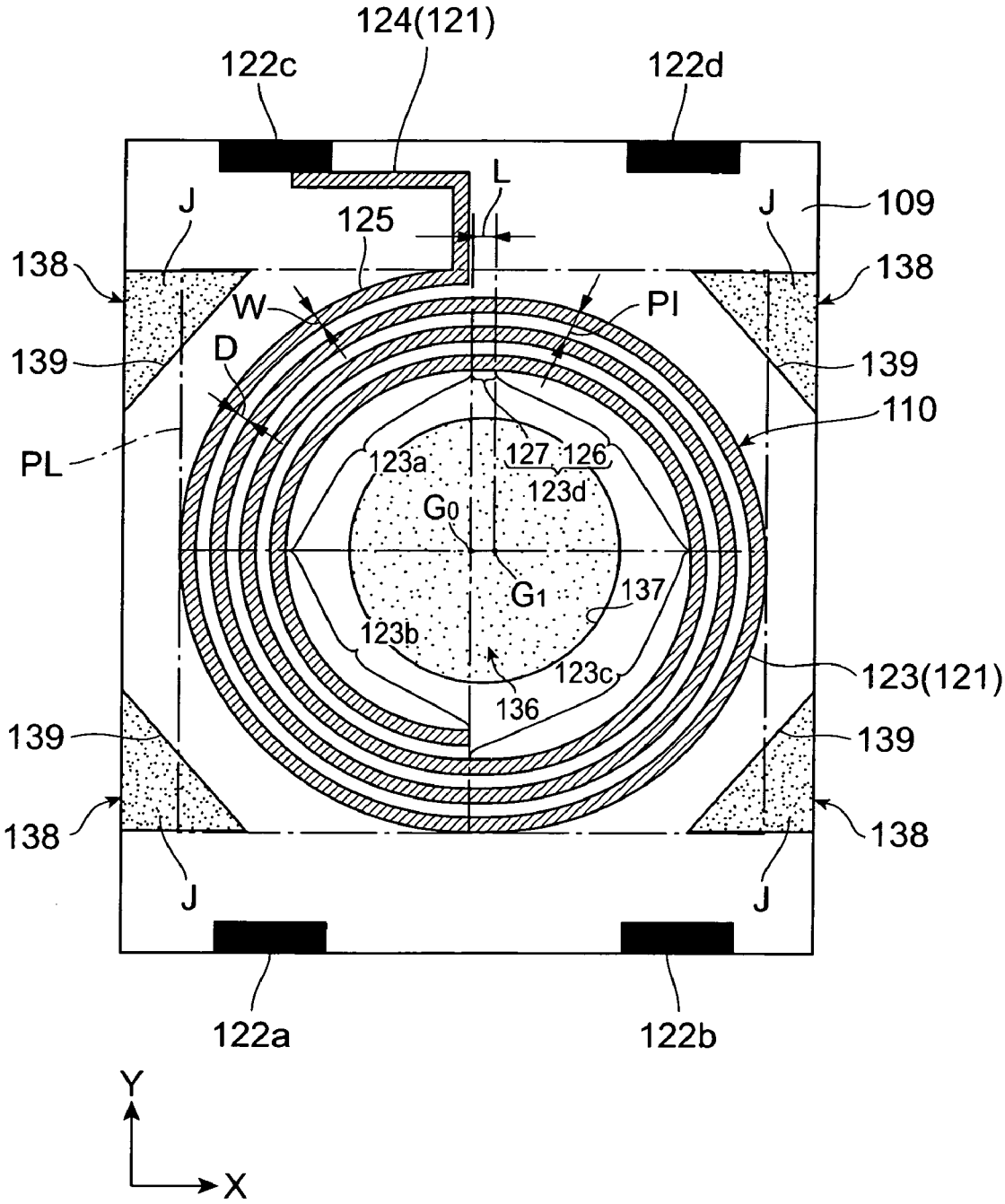
FIG. 14 is a plan view showing the second-lowest insulating layer and the conductor layer formed thereon that are shown in FIG. 12.

The conductor layer 110 is formed on the insulating layer 109. As shown in FIG. 14, the conductor layer 110 has a coil conductor 121 and lead electrodes 122*a* to 122*d*. The conductor layer 110 is formed from the same metal material as that for the conductor layer 108. The lead electrodes 122*a* to 122*d* are formed at respective positions corresponding to the lead electrodes 120*a* to 120*d*.

The coil conductor 121 is constituted by a spiral portion 123 formed helically, and an L-shaped lead portion 124 which is connected to the outer end portion of the spiral portion 123 and extends to the lead electrode 122*c*. In the spiral portion 123, a width W of the conductor pattern 125 forming the coil conductor 121 and a gap D within the conductor pattern 125 are totally the same. Therefore, a winding pitch PI of the conductor pattern 125 becomes totally the same in the spiral portion 123. The winding pitch PI of the conductor pattern 125 is represented by the sum of the width W of the conductor pattern 125 and the gap D within the conductor pattern 125.

The spiral portion 123 is formed so as to become substantially circular as a whole. Specifically, the spiral portion 123 is constituted by four coil areas 123*a* to 123*d* sectioned at intervals of 90 degrees with respect to a center position (first arc forming center position) $G_0$ within the inner area of the spiral portion 123.

The coil areas 123*a* to 123*c* are formed such that the conductor pattern 125 forming the coil conductor 121 becomes an arc centered at the first arc forming center position $G_0$.

The coil area 123*d* is constituted by an arc region 126 adjacent to the coil area 123*c* and a linear region 127 positioned between the coil region 123*a* and the arc region 126. The arc region 126 is formed such that the conductor pattern 125 forming the coil conductor 121 becomes an arc centered at a position (second arc forming center position) $G_1$ separated by a predetermined amount in an X direction (direction perpendicular to a direction along which the lead electrodes oppose each other) from the first arc forming center position $G_0$. The linear region 127 is formed such that the conductor pattern 125 becomes a line extending in the X direction from the coil area 123*a* to the arc region 126.

In the spiral portion 123, the width W and winding pitch PI of the conductor pattern 125 are totally the same as mentioned above. Therefore, the second arc forming center position $G_1$ is separated by the winding pitch (1 pitch) PI of the conductor pattern 125 in the X direction from the first arc forming center position $G_0$, while the length L of the linear portion of the conductor pattern 125 in the linear region 127 is made identical to the winding pitch PI of the conductor pattern 125. As a consequence, the portion of conductor pattern 125 existing in the coil area 123*a* and the portion of conductor pattern 125 existing in the coil area 123*b* reliably connect with each other through the portion of conductor pattern 125 existing in the coil area 123*d*, thus yielding the substantially circular spiral portion in which the conductor pattern 125 is partly linear.

The inner end portion of the spiral portion 123 is provided in the coil area 123*b*, whereas the outer end portion of the spiral portion 123 is provided in the coil area 123*a*. Consequently, the number of windings of conductor pattern 125 existing in the coil area 123*d* is smaller by 1 than the number of windings of conductor pattern 125 existing in each of the coil areas 123*a*, 123*b*.

The lead portion 124 is arranged on the opposite side of the lead conductor 118. One end of the lead portion 124 is connected to the lead electrode 122*c*, whereas the other end of the lead portion 124 is connected to the outer end portion of the spiral portion 123.

The insulating layer 111 is formed on the conductor layer 110. The insulating layer 111 is made of the same resin material as that for the insulating layer 107.

Figure 15:
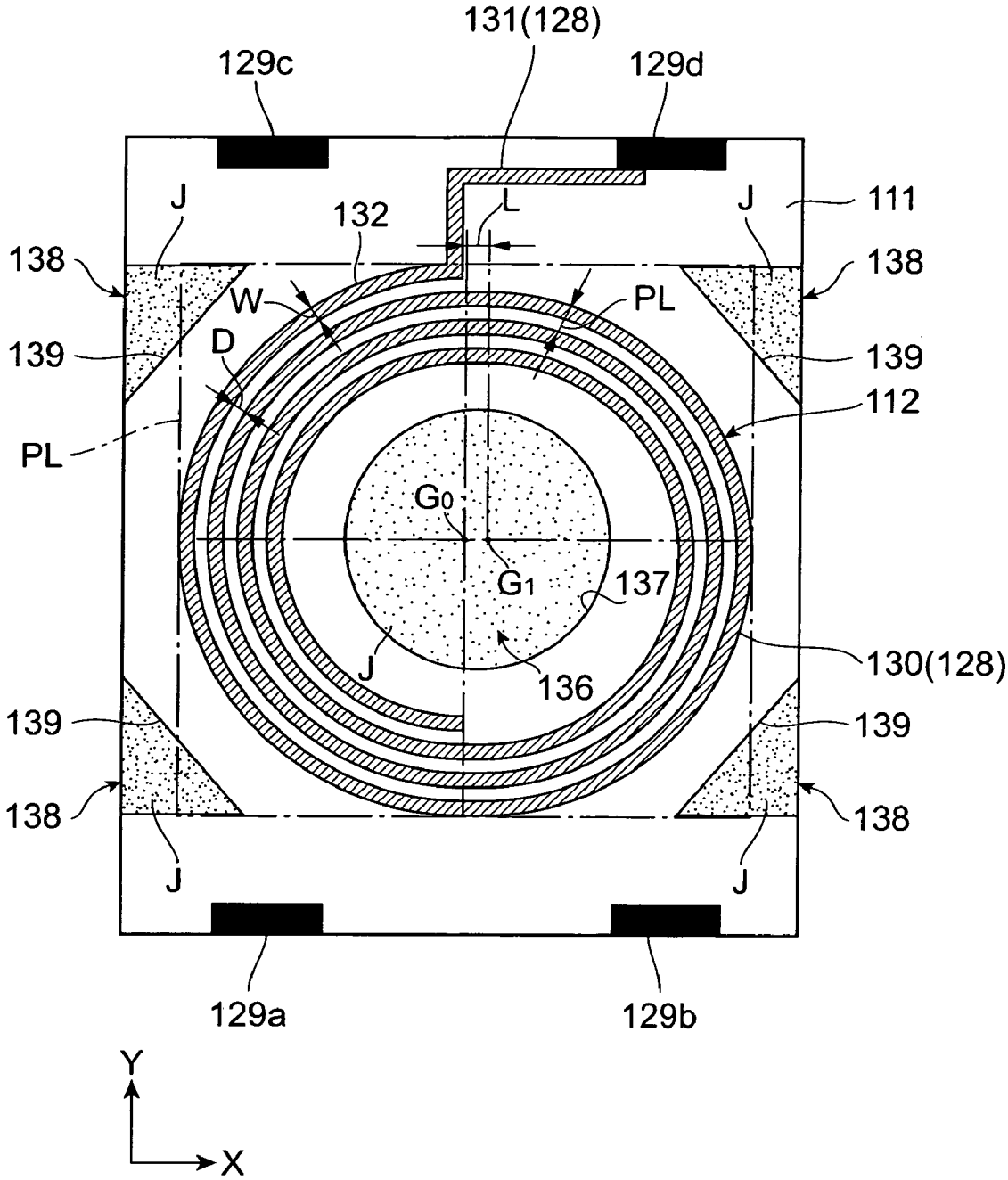
FIG. 15 is a plan view showing the third-lowest insulating layer and the conductor layer formed thereon that are shown in FIG. 12.

The conductor layer 112 is formed on the insulating layer 111. As shown in FIG. 15, the conductor layer 112 has a coil conductor 128 and lead electrodes 129*a* to 129*d*. The conductor layer 112 is formed from the same metal material as that for the conductor layer 108. The lead electrodes 129*a* to 129*d* are formed at respective positions corresponding to the lead electrodes 120*a* to 120*d*.

The coil conductor 128 is constituted by a spiral portion 130 formed helically, and an L-shaped lead portion 131 which is connected to the outer end portion of the spiral portion 130 and extends to the lead electrode 129*d*. The structure of the spiral portion 130 is totally the same as that of the coil conductor 121. Namely, as with the spiral portion 123, the spiral portion 130 has a substantially circular form in which a portion of a conductor pattern 132 forming the coil conductor 128 is linear. The spiral portions 123, 130 vertically overlie each other with the insulating layer 111 interposed therebetween.

The lead portion 131 is formed on the same side as with the lead portion 124. One end of the lead portion 131 is connected to the lead electrode 129*d*, whereas the other end of the lead portion 131 is connected to the outer end portion of the spiral portion 130.

The insulating layer 113 is formed on the conductor layer 112. The insulating layer 113 is made of the same resin material as that for the insulating layer 107. The insulating layer 113 is formed with a contact hole (not depicted) for electrically connecting the coil conductor 128 to a lead conductor 133 (to be explained later).

Figure 16:
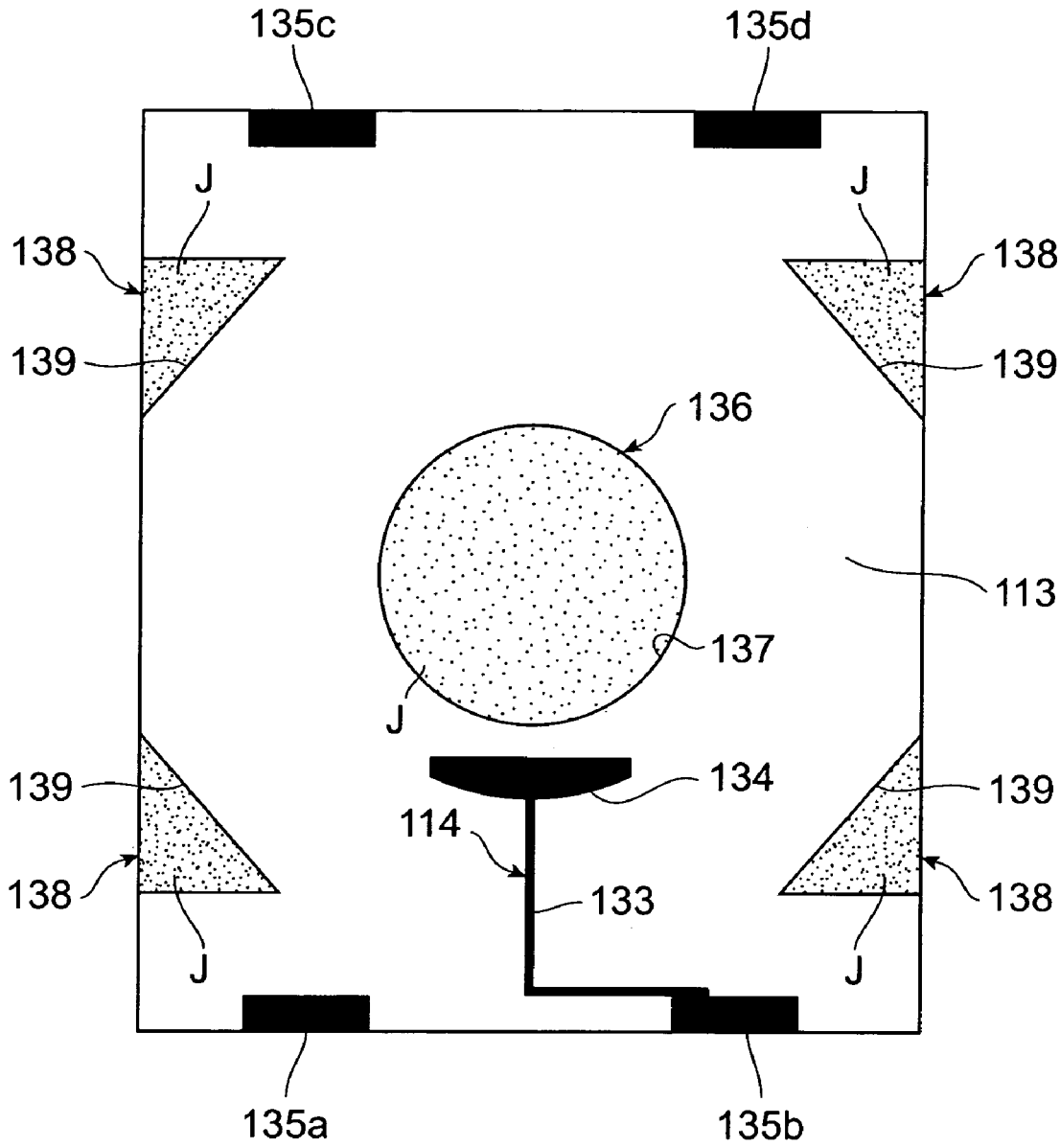
FIG. 16 is a plan view showing the fourth-lowest insulating layer and the conductor layer formed thereon that are shown in FIG. 12.
Figure 17:
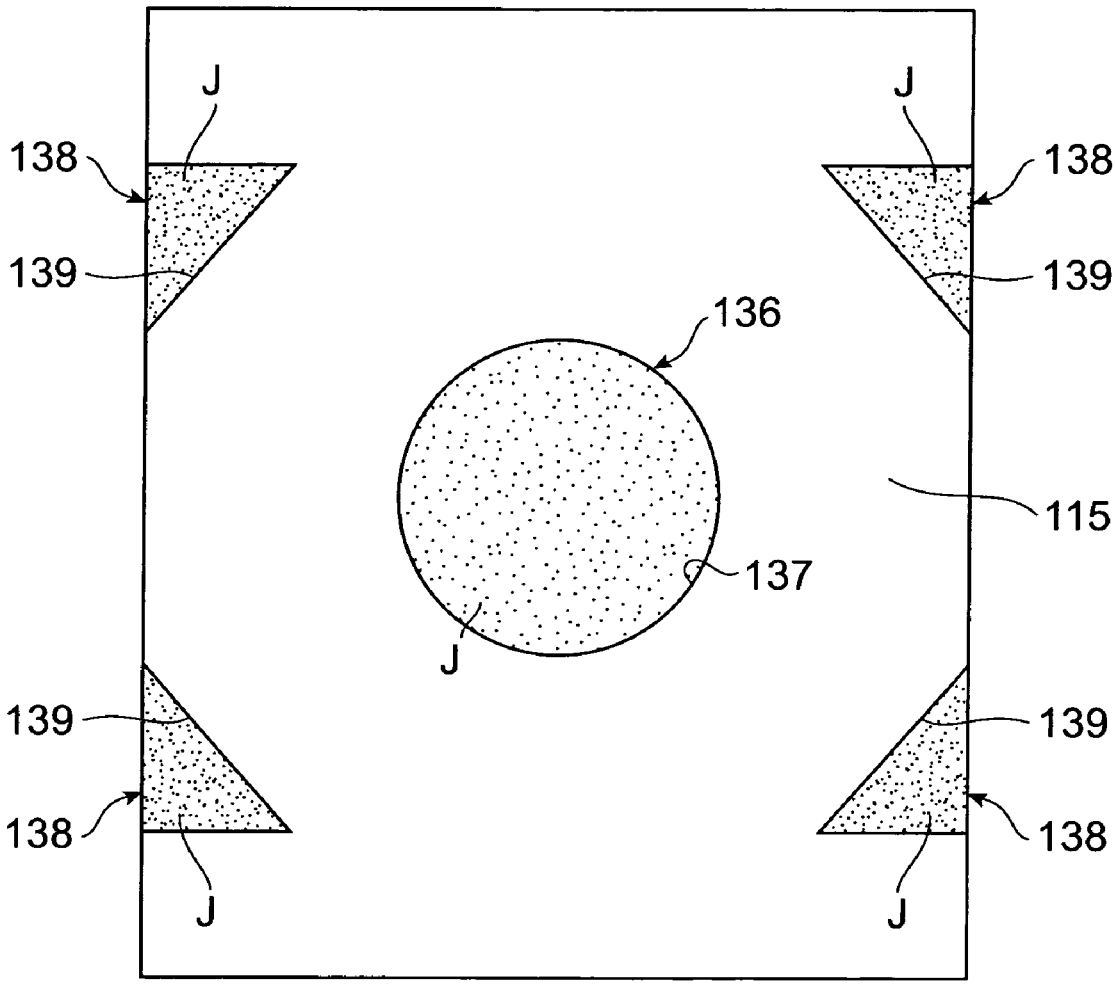
FIG. 17 is a plan view showing the fifth-lowest insulating layer shown in FIG. 12.

The conductor layer 114 is formed on the insulating layer 113. As shown in FIG. 16, the conductor layer 114 has a lead conductor 133, a connecting conductor 134, and lead electrodes 135*a* to 135*d*. The conductor layer 114 is formed from the same metal material as that for the conductor layer 108. The lead electrodes 135*a* to 135*d* are formed at respective positions corresponding to the lead electrodes 120*a* to 120*d*. The lead conductor 133 is formed like letter L on the same side as with the lead conductor 118. One end of the lead conductor 133 is connected to the lead electrode 135*b*, whereas the other end of the lead conductor 133 is connected to the connecting conductor 134.

The insulating layer 115 is formed on the conductor layer 114. The insulating layer 115 is made of the same resin material as that for the insulating layer 107.

The magnetic layer 116 is formed on the insulating layer 115. The magnetic layer 116 is a layer for forming a closed magnetic path in the common-mode choke coil CC2. The magnetic layer 116 is formed from a magnetic material such as a resin containing powdery ferrite (magnetic-powder-containing resin), for example.

The bonding layer 117 is formed on the magnetic layer 116 and bonds the magnetic layer 116 to the upper magnetic substrate 104. The bonding layer 117 is constituted by an adhesive such as epoxy resin, polyimide resin, or polyamide resin, for example.

In the insulating layers 109, 111, 113, 115, portions corresponding to the inner areas of the spiral portions 123, 130 are formed with an inner insulation removing portion 136 for forming a closed magnetic path as shown in FIGS. 12 and 14 to 17. The inner insulation removing portion 136 is constructed by forming a through hole 137 in the insulating layers 109, 111, 113, 115 and filling the through hole 137 with the same magnetic material J as the magnetic material forming the magnetic layer 116. The inner insulation removing portion 136 (through hole 137) preferably has a circular cross section corresponding to the substantially circular spiral portions 123, 130.

In the insulating layers 109, 111, 113, 115, each of portions corresponding to outer areas of the spiral portions 123, 130 is provided with four outer insulation removing portions 138 for forming a magnetic path. The outer insulation removing portions 138 are constructed by forming the insulating layers 109, 111, 113, 115 with cutout portions 139 and filling the cutout portions 139 with the same magnetic material J as the magnetic material forming the magnetic layer 116.

As shown in FIGS. 14 and 15, the outer insulation removing portions 138 are placed at portions corresponding to four corners of a substantially square virtual perimeter PL surrounding the spiral portion 123, 130 in each of the insulating layers 109, 111, 113, 115. These are areas where a relatively large space can be attained in portions corresponding to the outer areas of the substantially circular spiral portions 123, 130 in the insulating layers 109, 111, 113, 115. The outer insulation removing portions 138 (cutout portions 139) preferably have a triangular cross section or a cross section partly having a curve conforming to an outer periphery of the spiral 123, 130.

The outer insulation removing portions 138 may be constructed by forming a through hole in the insulating layers 109, 111, 113, 115 and filling the through hole with the magnetic material J as with the inner insulation removing portion 136.

The terminal electrodes 106 are provided two by two on opposing side faces 105A, 105B (see FIG. 11) of the foregoing multilayer body 105. One of the two terminal electrodes 106 provided on the side face 105A of the multilayer body 105 is electrically connected to the lead electrodes 120*a*, 122*a*, 129*a*, 135*a*, whereas the other is electrically connected to the lead electrodes 120*b*, 122*b*, 129*b*, 135*b*. One of the two terminal electrodes 106 provided on the side face 105B of the multilayer body 105 is electrically connected to the lead electrodes 120*c*, 122*c*, 129*c*, 135*c*, whereas the other is electrically connected to the lead electrodes 120*d*, 122*d*, 129*d*, 135*d*.

In this embodiment, the coil conductors 121, 128 have widths and lengths satisfying the relationship represented by the above-mentioned expression (1).

A procedure of manufacturing thus constructed common-mode choke coil CC2 will now be explained. First, the multilayer body 105 is made as follows.

By spin coating, dipping, or spraying, for example, the above-mentioned resin material is applied onto the lower magnetic substrate 102 and cured, so as to form the insulating layer 107. Subsequently, for example, a conductor thin film is formed on the insulating layer 107, and a pattern for the lead conductor 118, connecting conductor 119, and lead electrodes 120*a* to 120*d* is formed by photolithography, whereby the conductor layer 108 is made.

Next, as in the method of forming the insulating layer 107, the insulating layer 109 is formed on the conductor layer 108. Then, a contact hole (not depicted) for electrically connecting the connecting conductor 119 to the coil conductor 121 is formed in the insulating layer 109 by etching, for example. Here, simultaneously with the forming of the contact hole, the resin is partly removed from the center portion of the insulating layer 109, so as to form the through hole 137, and the resin is partly removed from end portions of the insulating layer 109, so as to form four cutout portions 139.

Subsequently, by the same method as that of forming the connecting conductor 108, a pattern for the coil conductor 121 and lead electrodes 122*a* to 122*d* is formed on the insulating layer 109, whereby the conductor layer 110 is made. Then, as in the method of forming the insulating layers 107, 109, the insulating layer 111 is formed on the conductor layer 110, and the through hole 137 and four cutout portions 139 are formed in the insulating layer 111.

Next, by the same method as that of forming the conductor layer 108, a pattern of the coil conductor 128 and lead electrodes 129*a* to 129*d* is formed on the insulating layer 111, whereby the conductor layer 112 is made. Then, as in the method of forming the insulating layers 107, 109, the insulating layer 113 is formed on the conductor layer 112, and the through hole 137 and four cutout portions 139 are formed in the insulating layer 113.

Subsequently, by the same method as that of forming the conductor layer 108, a pattern of the lead conductor 133, connecting conductor 134, and lead electrodes 135*a* to 135*d* is formed on the insulating layer 113, whereby the conductor layer 114 is made. Then, as in the method of forming the insulating layers 107, 109, the insulating layer 115 is formed on the conductor layer 114, and the through hole 137 and four cutout portions 139 are formed in the insulating layer 115.

Figure 18:
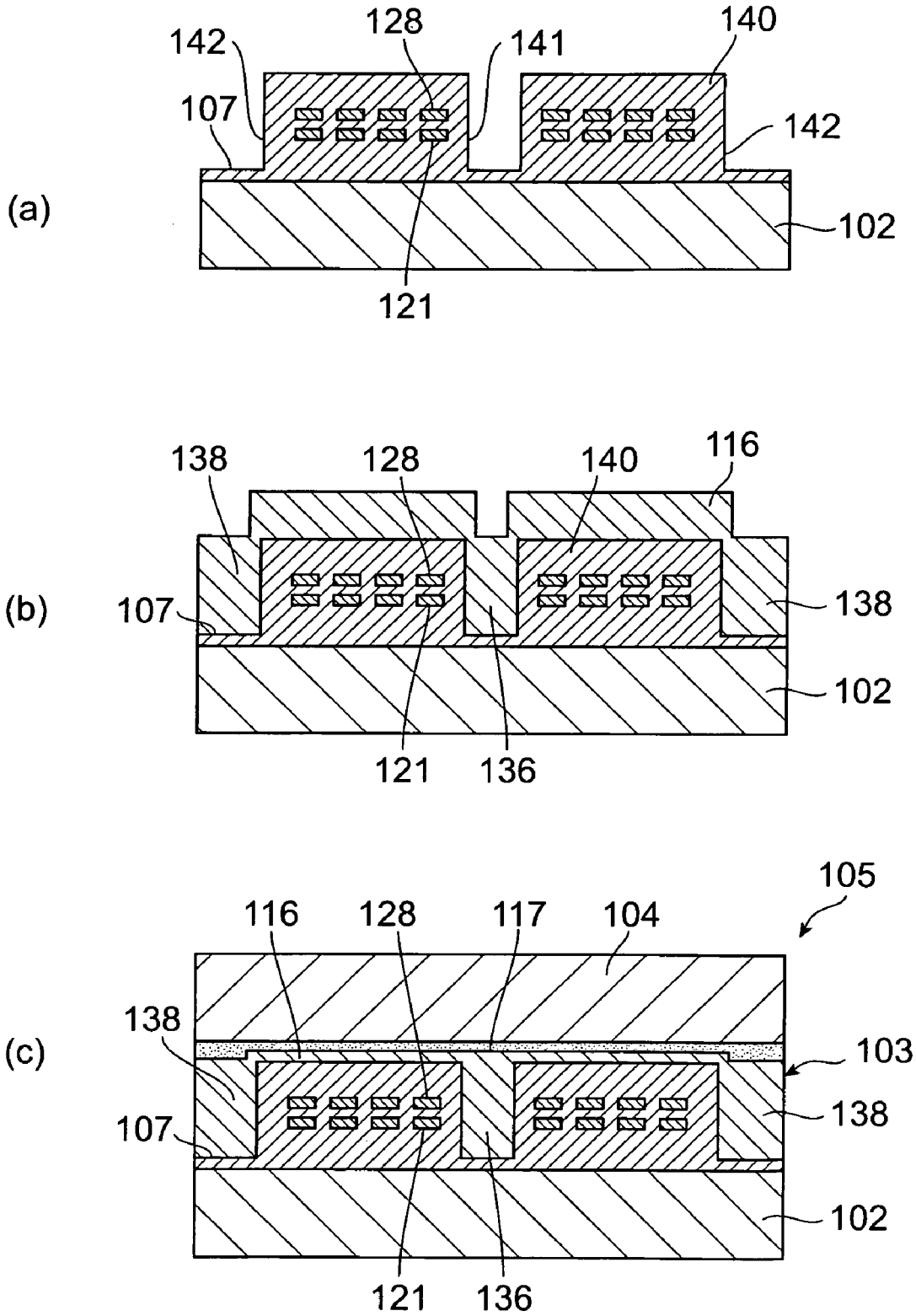
FIG. 18 is a sectional view showing steps of making the element shown in FIG. 12.

Consequently, a layer structure intermediate 140 incorporating the coil conductors 121, 128 therein is formed on the lower magnetic substrate 102 as shown in (a) of FIG. 18. The layer structure intermediate 140 is formed with a depression 141 caused by the through hole 137 of the insulating layers 109, 111, 113, 115 and four cutout portions 142 caused by the cutout portions 139 of the insulating layers 109, 111, 113, 115 while leaving the lowermost insulating layer 107.

Next, as shown in (b) of FIG. 18, a magnetic-powder-containing resin is cured while in a state where the depression 141 and cutout portions 142 are filled therewith and the upper face of the layer structure intermediate 140 is coated therewith. This forms the layer structure intermediate 140 with the inner insulation removing portion 136 and outer insulation removing portions 138, and the magnetic layer 116 on the layer structure intermediate 140. Then, the magnetic layer 116 is polished such that the upper face thereof is flattened.

Subsequently, as shown in (c) of FIG. 18, an adhesive such as epoxy resin is applied onto the magnetic layer 116, so as to form the bonding layer 117. Then, the upper magnetic substrate 104 is attached to the upper face of the bonding layer 117. This yields the multilayer body 105.

Here, the lowermost insulating layer 107 is an insulating layer formed with no contact holes. Since the lowermost insulating layer 107 is free of the inner insulation removing portion 136 and outer insulation removing portions 138 as mentioned above, the insulating layer 107 is not required to be subjected to boring and the like at all, whereby the number of man-hours can be reduced.

Thereafter, the terminal electrodes 106 are formed two by two on the opposing side faces 105A, 105B of the multilayer body 105. Specifically, for example, the side faces 105A, 105B of the multilayer body 105 are formed with a Cr/Cu film or Ti/Cu film by mask sputtering, and then thus formed film is electroplated with Ni/Sn, so as to form the terminal electrodes 106. The foregoing process completes the common-mode choke coil CC2.

Figure 19:
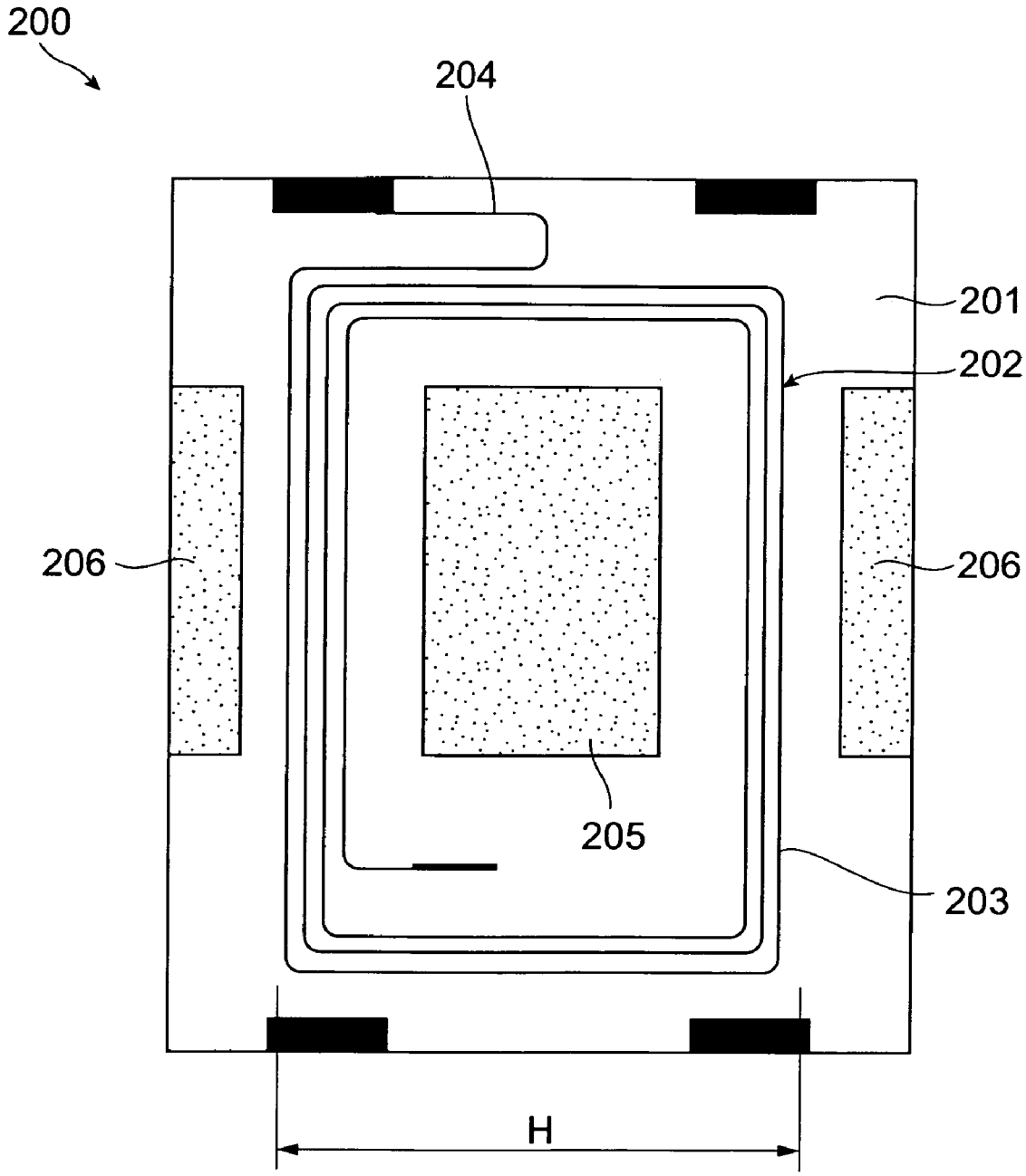
FIG. 19 is a plan view showing an insulating layer and a conductor layer formed on this insulating layer in a conventional common-mode choke coil as a comparative example.

FIG. 19 shows one of conventional common-mode choke coils as a comparative example. The common-mode choke coil 200 in this drawing includes an insulating layer 201 and a conductor layer 202 formed on the insulating layer 201. The conductor layer 202 has a coil conductor 204 including a substantially quadrangular spiral portion 203. In the insulating layer 201, a portion corresponding to the inner area of the spiral portion 203 is provided with an inner insulation removing portion 205 for forming a closed magnetic path. In the insulating layer 201, a portion corresponding to the outer area of the spiral portion 203 is provided with two outer insulation removing portions 206 for forming a closed magnetic path holding the spiral portion 203 therebetween. Each of the inner insulation removing portion 205 and outer insulation removing portions 206 has a rectangular cross section.

Unlike such a common-mode choke coil 200, the spiral portion 123 of the coil conductor 121 and the spiral portion 130 of the coil conductor 128 are circular in the common-mode choke coil CC2 in accordance with this embodiment. Therefore, the length of the conductor pattern 125 forming the spiral portion 123 and the length of the conductor pattern 132 forming the spiral portion 130 can reliably be made shorter by the length of linear portions than those in the substantially quadrangular spiral portion 203.

For sufficiently shortening the length of a conductor pattern forming a spiral portion, it will be ideal if the conductor pattern is made circular as a whole. However, such a structure is impossible since the spiral portion is continuous.

In this embodiment, the spiral portion 123 is constructed such that the width W and winding pitch PI of the conductor pattern 125 forming the coil conductor 121 are totally the same, while the spiral portion 123 is sectioned into the coil areas 123*a* to 123*d*. The coil areas 123*a* to 123*c* are constructed such that the conductor pattern 125 extends like an arc centered at the first arc forming center position $G_0$. On the other hand, the coil area 123*d* is constructed such that the conductor pattern 125 is constituted by the arc region 126 extending like an arc centered at the second arc forming center position $G_1$ separated by the winding pitch PI of the conductor pattern 125 from the first arc forming center position $G_0$ and the linear region 127 linearly extending by the winding pitch PI. In such a structure, the conductor pattern 125 is formed continuously as a whole and mostly as an arc. Consequently, the spiral portion 123 attains a structure which most efficiently shortens the line length of the conductor pattern 125. The same holds in the spiral portion 130 of the coil conductor 128.

This sufficiently shortens the line lengths of the conductor patterns 125 and 132 forming the coil conductors 121 and 128, respectively, whereby the common-mode choke coil CC2 attains a higher cutoff frequency. As a result, the common-mode choke coil CC2 operates normally even at a high transmission frequency, whereby the common-mode choke coil CC2 can be obtained with a favorable high-frequency characteristic.

In the common-mode choke coil 200 shown in FIG. 19, the spiral portion 203 of the coil conductor 204 has a substantially quadrangular form. Therefore, when the outer insulation removing portions 206 are provided at a portion corresponding to the outer area of the spiral portion 203 in the insulating layer 201 as mentioned above, the width H of the spiral portion 203 must be made smaller. As a consequence, when the outer dimensions of the common-mode choke coil 200 are limited, the space of the inner area of the spiral portion 203 becomes narrower accordingly, which also makes it necessary to reduce the size of the inner insulation removing portion 205 to be provided at a portion corresponding to the inner area of the spiral portion 203 in the insulating layer 201.

Though the inner insulation removing portion 205 is provided in order to attain a common-mode choke coil having a high inductance (high impedance), the impedance raising effect cannot fully be obtained if the inner insulation removing portion 205 becomes smaller.

In this embodiment, by contrast, the spiral portion 123 of the coil conductor 121 is made circular, whereby the outer insulation removing portions 138 can be formed by utilizing an effective space in the outer area of the spiral portion 123. Namely, the outer insulation removing portions 138 are provided at portions corresponding to four corners of the substantially square virtual perimeter PL surrounding the spiral portion 123 in the insulating layer 109, which makes it unnecessary to reduce the size of the spiral portion 123 in order to secure a space for the outer insulation removing portions 138. The same holds in the spiral portion 130 of the coil conductor 128. As a consequence, the inner insulation removing portion 136 having a large size can be provided by effectively utilizing a large space of the inner area in the spiral portions 123, 130. This can fully increase the impedance of the common-mode choke coil CC2.

In this embodiment, as in the foregoing, the coil conductors 121, 128 having the substantially circular respective spiral portions 123, 130 most effectively shortening their line lengths are provided, whereby the common-mode choke coil CC2 having a favorable high-frequency characteristic can be obtained. Also, since favorable magnetic path structures are formed in the inner and outer areas of the spiral portions 123, 130, the common-mode choke coil CC2 can be obtained with a high impedance. This can restrain leakage magnetic fluxes from generating noises. The foregoing makes it possible to secure a high transmission characteristic when performing high-speed data transmission, for example.

Also, the common-mode choke coil CC2 can be made smaller since closed magnetic paths having a favorable space efficiency are formed therein.

Figure 20:
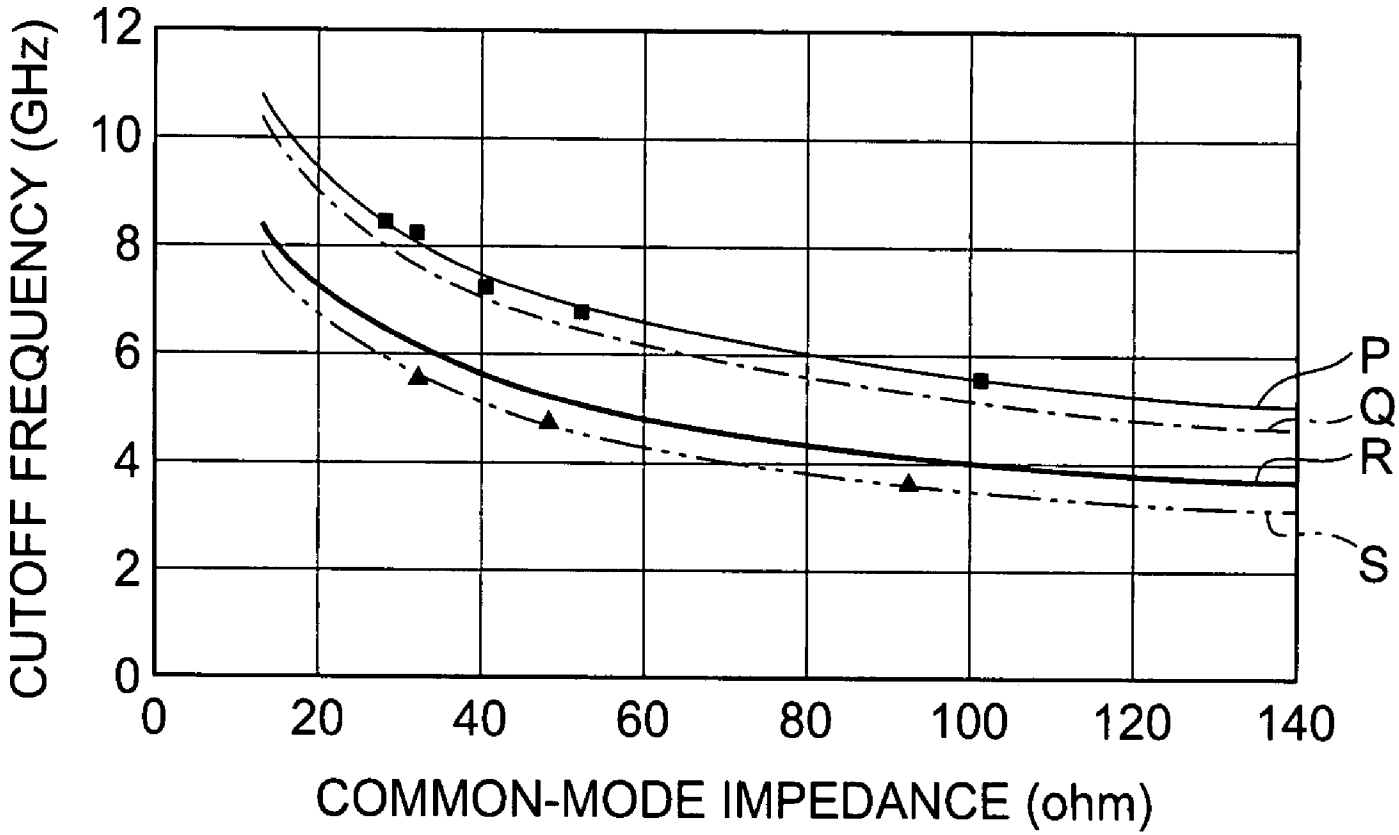
FIG. 20 is a graph showing relationships between simulated common-mode impedance and cutoff frequency in various samples of common-mode choke coils.

FIG. 20 is a graph showing relationships between simulated common-mode impedance and cutoff frequency in various samples of common-mode choke coils.

In the graph shown in FIG. 20, characteristic P concerns a sample having the same structure as that of the common-mode choke coil in accordance with the above-mentioned embodiment. Characteristic Q concerns a sample provided with the inner insulation removing portion without the outer insulation removing portions in the common-mode choke coil of the above-mentioned embodiment. Characteristic R concerns a sample not provided with any of the inner and outer insulation removing portions in the common-mode choke coil of the above-mentioned embodiment. Characteristic S concerns a sample having the same structure as that of the common-mode choke coil in accordance with the comparative example shown in FIG. 19. The abscissa and ordinate of the graph indicate the common-mode impedance and cutoff frequency, respectively.

FIG. 20 clearly shows that a higher cutoff frequency can be realized at the same common-mode impedance when the spiral portion of the coil conductor has a substantially circular form as mentioned above. When the spiral portion of the coil conductor has a substantially circular form, a higher cutoff frequency is obtained even in the case where the inner and outer insulation removing portions for forming a closed magnetic path are not provided at all (see characteristic R) than in the comparative example provided with the inner and outer insulation removing portions (see characteristic S). The effect of the present invention is considered to be proved by the foregoing.

Figure 21:
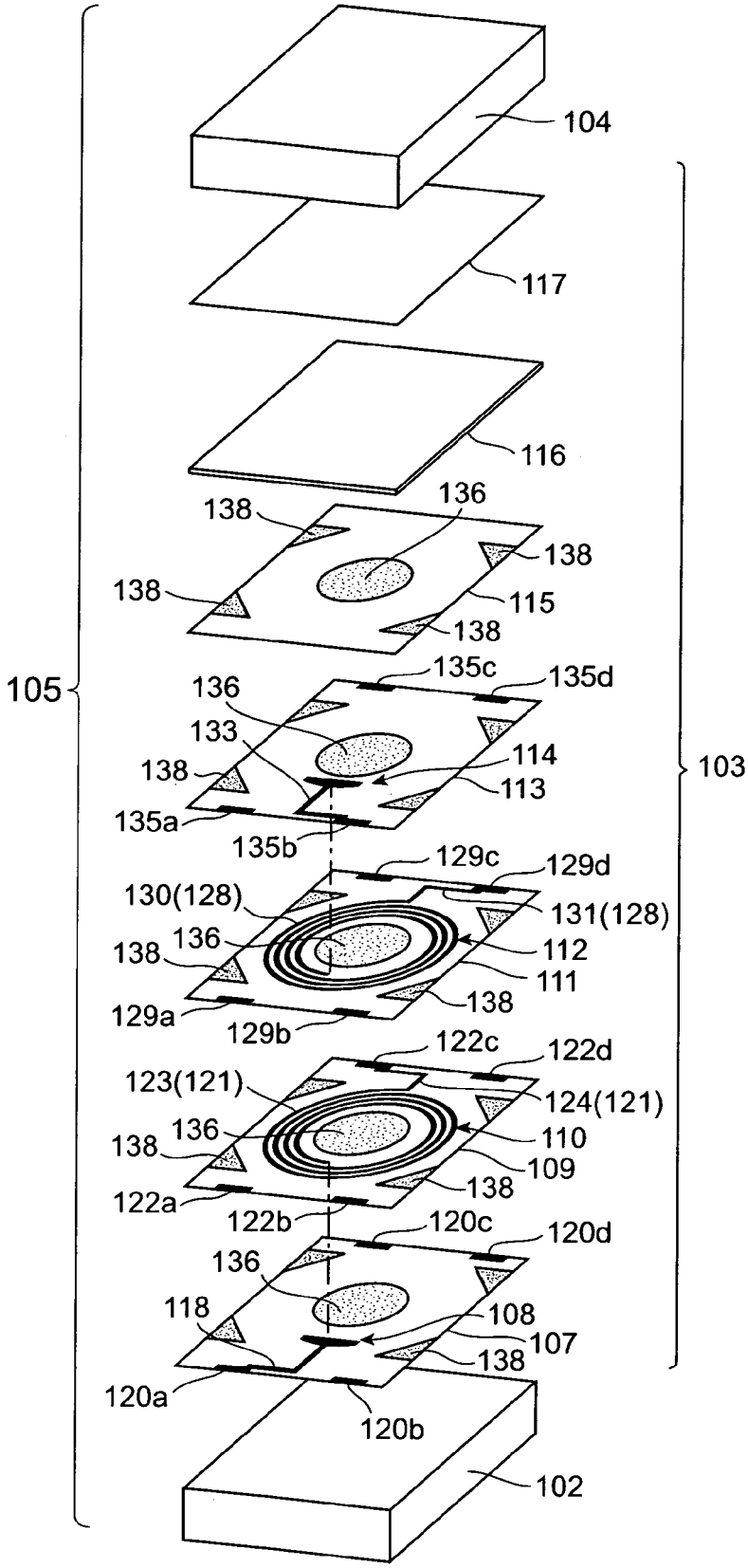
FIG. 21 is an exploded perspective view showing a modified example of the element shown in FIG. 12.
Figure 22:
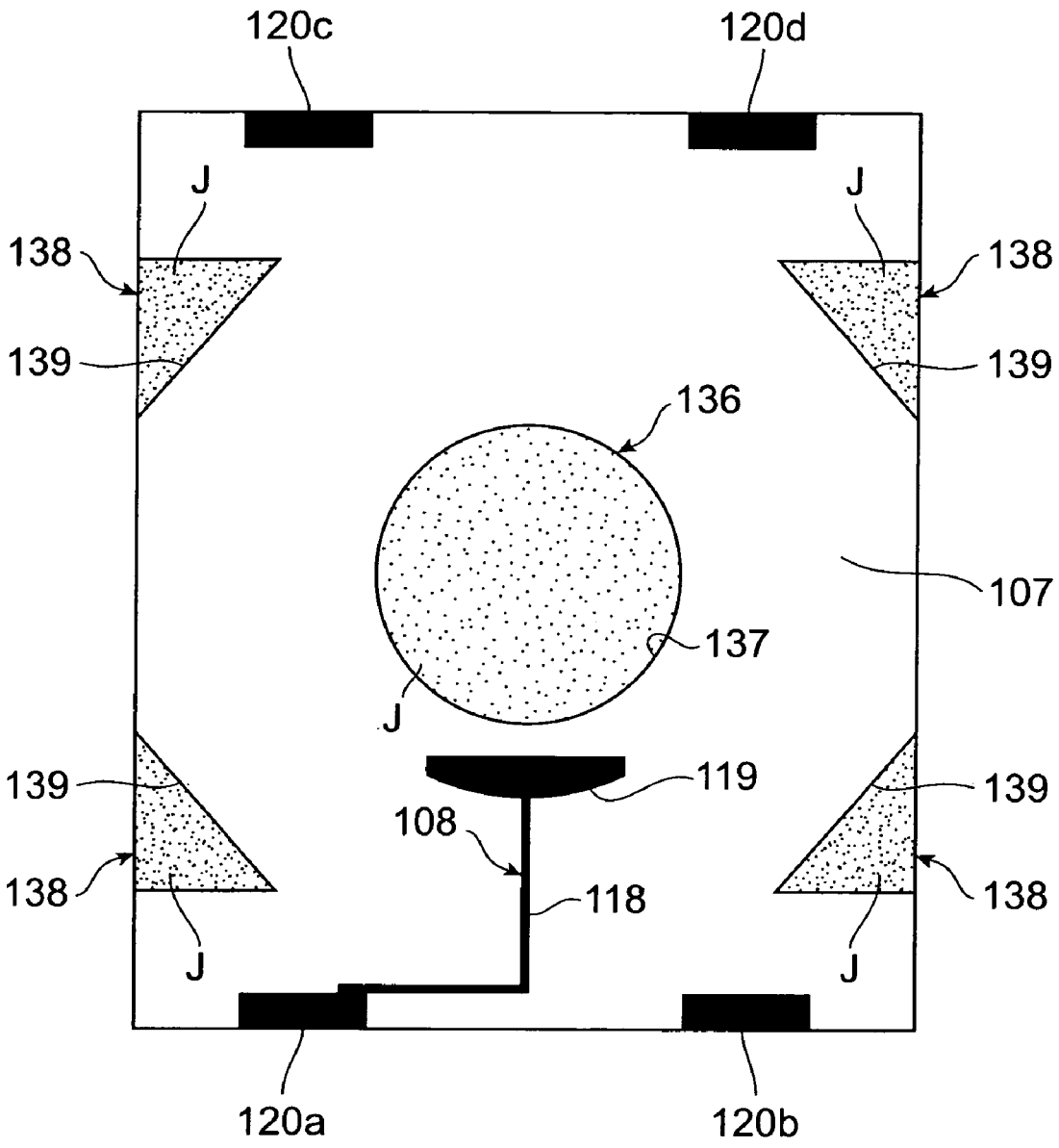
FIG. 22 is a plan view showing the lowermost insulating layer and the conductor layer formed on this insulating layer that are shown in FIG. 21.
Figure 23:
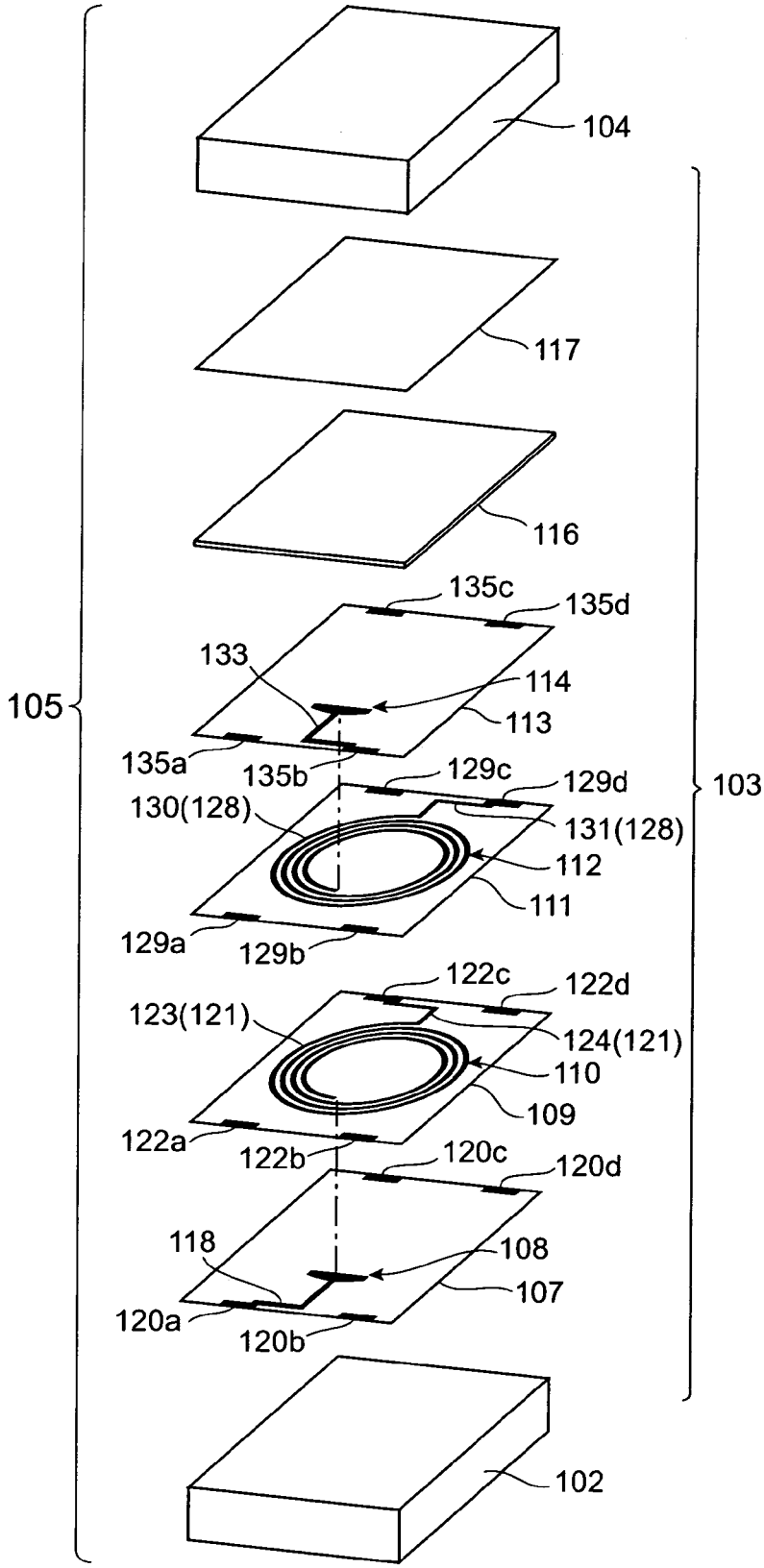
FIG. 23 is an exploded perspective view showing another modified example of the element shown in FIG. 12.

Though the lowermost insulation layer 107 in the layer structure 103 in the third embodiment is free of the inner insulation removing portion 136 and outer insulation removing portions 138, the lowermost insulating layer 107 may also be provided with the inner insulation removing portion 136 and outer insulation removing portions 138 as shown in FIGS. 21 and 22. In this case, the area of closed magnetic paths increases accordingly, whereby the common-mode choke coil CC2 can attain a higher impedance.

Though each insulating layer is provided with both of the inner insulation removing portion 136 and outer insulation removing portions 138 in the third embodiment, each insulating layer may be provided with only the inner insulation removing portion 136 or outer insulation removing portions 138. The pattern for providing insulation removing portions for forming a closed magnetic path can be changed in various manners, for example, such that a predetermined insulating layer is provided with only the inner insulation removing portion 136 while the other insulating layers are provided with only the outer insulation removing portions 138, and the same insulating layer is provided with three or less outer insulation removing portions when providing the outer insulation removing portions 138.

Further, as shown in FIG. 22, the insulating layers 107, 109, 111, 113, 115 may be totally free of the inner insulation removing portion 136 and outer insulation removing portions 138. In this case, the magnetic layer 117 is unnecessary, which simplifies the structure of the common-mode choke coil CC2. Even in such a structure, when the spiral portions 123, 130 have a substantially circular form as mentioned above, the common-mode choke coil CC2 can attain a higher cutoff frequency, whereby the common-mode choke coil CC2 can be obtained with a favorable high-frequency characteristic.

Though the coil area 123*d* of the spiral portion 123 in the coil conductor 121 is constituted by the arc region 126 and the linear region 127 in the third embodiment, any of the coil areas 123*a* to 123*c* in the spiral portion 123 may be constituted by the arc region 126 and linear region 127 as a matter of course. In this case, the arc region may be formed as an arc centered at a position separated by a predetermined amount in a Y direction (a direction along which the lead electrodes oppose each other) from the first arc forming center position $G_0$.

Though the common-mode choke coil CC2 in accordance with the third embodiment includes coil conductors 121, 128 laminated with the insulating layer 111 interposed therebetween, the present invention can also be employed in a common-mode choke coil having three or more coil conductors. The present invention is also employable in common-mode choke coils of so-called array type in which one conductor layer has a plurality of coil conductors.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A common-mode choke coil comprising first and second coil conductors laminated with an insulating layer interposed therebetween and magnetically coupled to each other;

wherein a width W (mm) and a length L (mm) of at least one coil conductor in the first and second coil conductors satisfy the relational expression of:

$$\sqrt{L/W} < (7.6651 - fc)/0.1385$$

where fc (MHz) is a cutoff frequency with respect to differential-mode noise.

2. The common-mode choke coil according to claim 1, wherein each of the first and second coil conductors has a substantially helical form including a plurality of linear portions and a plurality of bent portions connecting the linear portions to each other; and wherein at least one bent portion in the plurality of bent portions is flexed by a predetermined curvature in the coil conductor satisfying the relational expression in the first and second coil conductors.

3. The common-mode choke coil according to claim 1, wherein each of the first and second coil conductors has a helical form made of a curve.

4. The common-mode choke coil according to claim 1, wherein each of the first and second coil conductors includes a spiral portion, formed helically, having totally the same width and winding pitch of respective conductor patterns forming the coil conductors;

wherein the respective spiral portions of the coil conductors overlie each other with the insulating layer interposed therebetween;

wherein each spiral portion comprises four coil areas sectioned at intervals of 90 degrees with respect to a predetermined position within an inner area of the spiral portion;

wherein three of the four coil areas form an arc centered at the predetermined position; and wherein the remaining one coil area comprises an arc region formed as an arc centered at a position separated by the winding pitch of the conductor pattern from the predetermined position and a linear region formed between one of the three coil areas and the arc region such that the conductor pattern becomes a line by the winding pitch of the conductor pattern.

5. The common-mode choke coil according to claim 4, wherein each of the first and second coil conductors further comprises a lead portion, extending toward an edge portion of the insulating layer;

wherein one of the three coil regions is provided with a junction between the spiral portion and lead potion; and wherein the remaining one coil region is adjacent to the coil region having the junction between the spiral portion and lead portion.

6. The common-mode choke coil according to claim 4, wherein a portion corresponding to the inner area of the spiral portion in the insulating layer is provided with an inner insulation removing portion for forming a magnetic path made by forming a hole and filling the hole with a magnetic material.

7. The common-mode choke coil according to claim 4, wherein a portion corresponding to an outer area of the spiral portion in the insulating layer is provided with an outer insulation removing portion for forming a magnetic path made by forming a hole or cutout and filling the hole or cutout with a magnetic material; and wherein the outer insulation removing portion is placed at a portion corresponding to a corner of a substantially square virtual perimeter surrounding the spiral portion in the insulating layer.

8. The common-mode choke coil according to claim 1, wherein each of first and second coil conductors includes a spiral portion formed into a substantially circular helix;

wherein the respective spiral portions of the coil conductors overlie each other with the insulating layer interposed therebetween;

wherein a portion corresponding to an inner area of the spiral portion in the insulating layer is provided with a first insulation removing portion for forming a magnetic path made by forming a hole and filling the hole with a magnetic material;

wherein a portion corresponding to an outer area of the spiral portion in the insulating layer is provided with a second insulation removing portion for forming a magnetic path made by forming a hole or cutout and filling the hole or cutout with the magnetic material; and wherein the second insulation removing portion for forming a magnetic path is placed at a portion corresponding to a corner of a substantially square virtual perimeter surrounding the spiral portion in the insulating layer.

9. The common-mode choke coil according to claim 8, wherein a plurality of insulating layers are laminated so as to alternate with the coil conductors; and wherein all the insulating layers except for the lowermost insulating layer are provided with the first and second insulation removing portions.

10. The common-mode choke coil according to claim 8, wherein a plurality of insulating layers are laminated so as to alternate with the coil conductors; and wherein all the insulating layers are provided with the first and second insulation removing portions.

11. The common-mode choke coil according to claim 8, wherein respective portions corresponding to four corners of the substantially square virtual perimeter in the insulating layer are provided with second insulation removing portions.

12. The common-mode choke coil according to claim 8, wherein the first insulation removing portion has a circular cross section.

13. The common-mode choke coil according to claim 8, wherein the second insulation removing portion has a triangular cross section or a cross section partly having a curve conforming to an outer periphery of the spiral portion.

* * * * *